US009242760B2

(12) United States Patent
Nevo

(10) Patent No.: US 9,242,760 B2
(45) Date of Patent: Jan. 26, 2016

(54) PALLET AND BEAMS

(71) Applicant: Roni Pal Israel 2000 Ltd., Tel-Aviv (IL)

(72) Inventor: Shlomo Nevo, Tel-Aviv (IL)

(73) Assignee: Roni Pal Israel 2000 Ltd., Tel-Aviv (IL)

( * ) Notice: Subject to any disclaimer, the term of this patent is extended or adjusted under 35 U.S.C. 154(b) by 0 days.

(21) Appl. No.: 14/379,771

(22) PCT Filed: Feb. 20, 2013

(86) PCT No.: PCT/IL2013/050148

§ 371 (c)(1),
(2) Date: Aug. 20, 2014

(87) PCT Pub. No.: WO2013/124846

PCT Pub. Date: Aug. 29, 2013

(65) Prior Publication Data

US 2015/0013573 A1 Jan. 15, 2015

Related U.S. Application Data

(60) Provisional application No. 61/600,740, filed on Feb. 20, 2012.

(51) Int. Cl.

| | |
|---|---|
| ***B65D 19/00*** | (2006.01) |
| ***B65D 25/24*** | (2006.01) |
| ***B65D 19/40*** | (2006.01) |

(52) U.S. Cl.

CPC ..... *B65D 19/0004* (2013.01); *B65D 19/0018* (2013.01); *B65D 19/40* (2013.01); *B65D 25/24* (2013.01); *B65D 2519/00034* (2013.01); *B65D 2519/00069* (2013.01); *B65D 2519/00139* (2013.01); *B65D 2519/00268* (2013.01); *B65D 2519/00273* (2013.01);

(Continued)

(58) Field of Classification Search

CPC ..... B65D 2519/00323; B65D 2519/00398; B65D 2519/00432

USPC ..... 108/51.11, 57.25, 51.3, 55.5; 248/346.02

See application file for complete search history.

(56) References Cited

U.S. PATENT DOCUMENTS 1,698,038 A * 1/1929 Warshaw et al. ..... 108/57.24
1,784,909 A 12/1930 Romine (Continued)

FOREIGN PATENT DOCUMENTS

| | | |
|---|---|---|
| CN | 1130141 | 9/1996 |
| EP | 0115551 | 8/1984 |

(Continued)

OTHER PUBLICATIONS

Communication Pursuant to Rules 70(2) and 70a(2) EPC Dated Aug. 9, 2013 From the European Patent Office Re. Application No. 09754340.9.

(Continued)

*Primary Examiner* — Jose V Chen

(57) ABSTRACT

A pallet for carrying load, comprising:
an upper surface for carrying load;
a bottom surface; and
at least one beam attached to the bottom surface, the beam comprising a curved force carrying element.

20 Claims, 39 Drawing Sheets

(52) U.S. Cl.
CPC ..... *B65D 2519/00288* (2013.01); *B65D 2519/00308* (2013.01); *B65D 2519/00318* (2013.01); *B65D 2519/00323* (2013.01); *B65D 2519/00338* (2013.01); *B65D 2519/00407* (2013.01); *B65D 2519/00437* (2013.01); *B65D 2519/00572* (2013.01); *Y10T 29/49826* (2015.01)

(56) References Cited

U.S. PATENT DOCUMENTS

| | | | | | |
|---|---|---|---|---|---|
| 2,089,865 | A | * | 8/1937 | Voss | 52/222 |
| 2,626,456 | A | * | 1/1953 | Harrison | 108/55.5 |
| 2,648,428 | A | | 8/1953 | White et al. | |
| 3,168,879 | A | * | 2/1965 | Clark, Jr. | 108/55.5 |
| 3,331,496 | A | * | 7/1967 | Marsden et al. | 108/55.5 |
| 3,433,184 | A | | 3/1969 | Addy | |
| 3,589,309 | A | * | 6/1971 | Clark, Jr. | 108/55.5 |
| 4,159,681 | A | * | 7/1979 | Vandament | 108/57.33 |
| 4,271,826 | A | * | 6/1981 | Duchene | 126/623 |
| 4,501,402 | A | | 2/1985 | Saito et al. | |
| 4,586,303 | A | * | 5/1986 | Jartoux et al. | 52/309.16 |
| 4,667,921 | A | * | 5/1987 | de Goncourt | 248/618 |
| 4,735,154 | A | * | 4/1988 | Hemery | 108/56.1 |
| 4,747,245 | A | * | 5/1988 | Lesmeister et al. | 52/309.7 |
| 5,042,396 | A | * | 8/1991 | Shuert | 108/57.25 |
| 5,117,762 | A | * | 6/1992 | Shuert | 108/57.25 |
| 5,255,613 | A | * | 10/1993 | Shuert | 108/52.1 |
| 5,549,056 | A | * | 8/1996 | Jordan et al. | 108/57.25 |
| 5,636,577 | A | | 6/1997 | Gow | |
| 5,649,640 | A | | 7/1997 | Hermann et al. | |
| 5,758,855 | A | * | 6/1998 | Jordan et al. | 248/346.01 |
| 5,816,172 | A | | 10/1998 | Carter | |
| 6,018,927 | A | * | 2/2000 | Major | 108/57.25 |
| 6,053,466 | A | * | 4/2000 | Jordan et al. | 248/346.01 |
| 6,317,981 | B1 | * | 11/2001 | Clive-Smith | 29/897.35 |
| 6,510,802 | B2 | | 1/2003 | Huang et al. | |
| 6,708,628 | B2 | | 3/2004 | Halavais | |
| 6,962,115 | B2 | * | 11/2005 | Markling et al. | 108/57.25 |
| 7,007,815 | B2 | * | 3/2006 | Anderson et al. | 211/191 |
| 8,695,512 | B2 | * | 4/2014 | Nevo et al. | 108/53.3 |
| 2004/0255828 | A1 | | 12/2004 | Markling et al. | |
| 2005/0081763 | A1 | | 4/2005 | Von Holle et al. | |
| 2007/0163473 | A1 | | 7/2007 | Shuert | |
| 2012/0037050 | A1 | | 2/2012 | Nevo et al. | |

FOREIGN PATENT DOCUMENTS

| | | |
|---|---|---|
| EP | 0718201 | 6/1996 |
| JP | 2003-137288 | 5/2003 |
| WO | WO 94/003368 | 2/1994 |
| WO | WO 97/18733 | 5/1997 |
| WO | WO 2008/142647 | 11/2008 |
| WO | WO 2010/095129 | 8/2010 |
| WO | WO 2013/124846 | 8/2013 |

OTHER PUBLICATIONS

International Preliminary Report on Patentability Dated Sep. 1, 2011 From the International Bureau of WIPO Re. Application No. PCT/IL2010/000138.

International Preliminary Report on Patentability Dated Sep. 4, 2014 From the International Bureau of WIPO Re. Application No. PCT/IL2013/050148.

International Search Report and the Written Opinion Dated Jun. 8, 2010 From the International Searching Authority Re. Application No. PCT/IL10/00138.

International Search Report and the Written Opinion Dated Jun. 23, 2013 From the International Searching Authority Re. Application No. PCT/IL2013/050148.

Notice of Allowance Dated Dec. 19, 2013 From the US Patent and Trademark Office Re. U.S. Appl. No. 13/202,094.

Office Action Dated Nov. 20, 2011 From the Israel Patent Office Re. Application No. 197105 and Its Translation Into English.

Official Action Dated Jun. 19, 2013 From the US Patent and Trademark Office Re. U.S. Appl. No. 13/202,094.

Official Action Dated Sep. 21, 2012 From the US Patent and Trademark Office Re. U.S. Appl. No. 13/202,094.

Supplementary European Search Report and the European Search Opinion Dated Jul. 23, 2013 From the European Patent Office Re. Application No. 10743466.4.

Notification of Office Action and Search Report Dated Jun. 30, 2015 From the State Intellectual Property Office of the People's Republic of China Re. Application No. 201380014515.0.

Translation Dated Jul. 27, 2015 of Office Action Dated Jun. 30, 2015 From the State Intellectual Property Office of the People's Republic of China Re. Application No. 201380014515.0.

* cited by examiner

100

300

300

600

600

600

PALLET AND BEAMS

RELATED APPLICATION APPLICATIONS

This application is a National Phase of PCT Patent Application No. PCT/IL2013/050148 having International filing date of Feb. 20, 2013, which claims the benefit of priority under 35 USC §119(e) of U.S. Provisional Patent Application No. 61/600,740 filed Feb. 20, 2012. The contents of the above applications are all incorporated by reference as if fully set forth herein in their entirety.

FIELD AND BACKGROUND OF THE INVENTION

The present invention, in some embodiments thereof, relates to carrying loads and, more particularly, but not exclusively, to pallets and beams for carrying loads.

A number of pallets are known in the art, for example:

U.S. Pat. No. 5,042,396 to Shuert discloses a plastic pallet in which an insert assembly is positioned within the hollow of the plastic pallet to discourage warpage and failure especially in racked, storage situations. The insert assembly comprises a pair of beams arranged in an X-configuration, tower members secured at their upper ends to respective ends of the beams and positioned respectively in the four corners of the pallet, and tensioning straps extending between the tower members around the perimeter of the pallet proximate to the upper surface of the bottom wall of the pallet. The X-configuration beams are positioned in the space between the spaced upper and lower sheets of the platform structure of the pallet and are maintained in a convexly bowed configuration by the tensioning straps so as to resist downward bowing of the platform structure, even when the pallet is racked for extended periods of time in a loaded position.

U.S. Pat. No. 6,962,115 to Markling et al. discloses a pallet system including a pallet body. The pallet body is formed from a first, independently formed first portion and a second blow molded second upper portion insert molded to the first portion. The pallet body may have two to eight recesses for forklift truck fork access. The second upper portion has a generally rectangular surface for carrying loads. The portions may have anti-skid properties, for example, a knurled topside surface or rubber coated bottom. At least one foot is attached to the second upper portion by insert molding. At least one runner may be attached to each foot to form part of the first portion. At least one stringer is attached to each runner to add further stability to the pallet. The runners and feet have channels or protruding members to effectively mate with the second upper portion. The system may also have top cap and tie members to affix the cap to one or more pallet bodies as well as high-friction inserts to permit the pallet from sliding on a surface or objects from sliding on the pallet.

WO2010/095129 by Nevo et al. discloses a pallet with a non-flat deck. The pallet can be reinforced by inserting or attaching reinforcement elements and can include taut cables that prevent or reduce the declining of the upper deck when the pallet is loaded.

SUMMARY OF THE INVENTION

An aspect of some embodiments of the invention relates to a pallet having at least one elongated support element, hereinafter referred to as a beam, wherein the beam comprises a curved force carrying element which may be reinforced by a tension element. Optionally, the at least one beam is removably attached to a bottom part of the pallet. Alternatively, the at least one beam is integrally attached to a bottom part of the pallet.

An aspect of some embodiments of the invention relates to a retrofit beam for pallets. Optionally, at least a portion of the beam has a curved force carrying element.

An aspect of some embodiments of the invention relates to a standalone beam which may be directly attached to a load, without requiring a pallet. The standalone beams may support the load during shipping, lifting with a forklift and/or racking.

An aspect of some embodiments of the invention relates to using a strap, which is used for attaching the load to a pallet, as a tension element for a beam. Optionally, the beam comprises a curved force carrying element and the strap maintains a curvature of the force carrying element when load is placed on the beam. Optionally, the beam is attached to a pallet. Alternatively, the beam is a standalone beam which is directly attached to a load.

An aspect of some embodiments of the invention relates to a beam, comprising two elongated elements positioned one beneath the other and a gap between the elongated elements. In some embodiments, tines (or forks) of a forklift can pass through the gap and lift the pallet. Optionally, the beams are diagonally attached to a bottom surface of a pallet.

According to an aspect of some embodiments of the present invention there is provided a pallet for carrying load, comprising:

an upper surface for carrying load;

a bottom surface; and at least one beam attached to the bottom surface, the beam comprising a curved force carrying element.

According to some embodiments of the invention, a tension element is attached along the length of the force carrying element for maintaining a curvature of the force carrying element.

According to some embodiments of the invention, the force carrying element is prestressed before attaching the tension element to the force carrying element.

According to some embodiments of the invention, the beam is prestressed by stressing the tension element.

According to some embodiments of the invention, the tension element is stressed to between 50-200 kg tensile strength.

According to some embodiments of the invention, the tension element comprises a cable attached to a hook and wherein the cable is stressed by rotating the hook.

According to some embodiments of the invention, the tension element comprises a cable and turnbuckle and wherein the cable is stressed by rotating the turnbuckle.

According to some embodiments of the invention, the force carrying element is in the form of a curved arch.

According to some embodiments of the invention, the force carrying element is in the form of a section of a dome.

According to some embodiments of the invention, at least three equally distanced beams are attached to the bottom surface of the pallet.

According to some embodiments of the invention, the pallet when racked is adapted to carry between 120-200 kg of load for each 1 kg of raw material of the pallet.

According to some embodiments of the invention, the pallet and beam are formed as an integral piece.

According to some embodiments of the invention, the at least one beam is removably attached to the pallet.

According to an aspect of some embodiments of the present invention there is provided a retrofit beam for a pallet, the retrofit device comprising:

at least one force carrying element; and support elements for attaching the retrofit to a bottom part of a pallet.

According to some embodiments of the invention, the length of the beam is substantially equal to the length of a side of the pallet.

According to some embodiments of the invention, the beam further comprises at least one tension element attached between the two ends of the force carrying element.

According to some embodiments of the invention, the beam is prestressed by stressing the tension element.

According to some embodiments of the invention, the tension element is stressed to between 50-200 kg tensile strength.

According to some embodiments of the invention, the beam is prestressed before attaching the tension element.

According to some embodiments of the invention, the support elements are adapted to be fastened to feet of the pallet.

According to some embodiments of the invention, the force carrying element is in the form of a curved arch.

According to some embodiments of the invention, the force carrying element is in the form of a triangular truss.

According to an aspect of some embodiments of the present invention there is provided a beam for directly attaching to a load, the beam comprising:

two support elements adapted to be attached to a strap of the load; and a force carrying element between the two support elements.

According to some embodiments of the invention, the support elements comprise a recess for receiving the strap of the load.

According to some embodiments of the invention, the strap of the load comprises a dent at the point of attachment to the recess of the support element.

According to some embodiments of the invention, the beam further comprises a tension element for preserving a stress of the force carrying element.

According to some embodiments of the invention, the tension element comprises the strap of the load which is attached through the support elements along the length of the force carrying element.

According to some embodiments of the invention, the tension element comprises at least one cable connected between two ends of the force carrying element.

According to some embodiments of the invention, the tension element is stressed to between 50-200 kg tensile strength.

According to some embodiments of the invention, the beam is prestressed before attaching the tension element.

According to some embodiments of the invention, the force carrying element is in the form of a curved arch.

According to some embodiments of the invention, the force carrying element is in the form of a triangular truss.

According to some embodiments of the invention, the beam is adapted to carry between 120-200 kg of load for each 1 kg of raw material of the beam.

According to an aspect of some embodiments of the present invention there is provided a method of attaching a strap to a beam, the method comprising:

providing a load;

providing a strap;

providing at least one beam for supporting the load;

placing the load on the beam; and closing the strap thereby attaching the load to the beam, such that the strap is attached along the length of the beam.

According to some embodiments of the invention, closing the strap further comprises closing the strap such that the strap acts as a tension element for the beam.

According to some embodiments of the invention, closing the strap is performed before placing the load on the beam.

According to some embodiments of the invention, closing the strap further comprises maintaining a stress of the beam.

According to some embodiments of the invention, attaching the strap along the length of the beam further comprises tightening the strap, thereby prestressing the beam.

According to some embodiments of the invention, attaching the strap along the length of the beam further comprises fastening the strap with a fastening element to the beam, thereby creating a dent at the point of attachment of the strap to the beam.

According to an aspect of some embodiments of the present invention there is provided a method of stressing a beam for carrying load, the method comprising:

prestressing a beam;

preserving a stress of the beam by attaching a tension element along the length of the beam; and placing load on the beam.

According to some embodiments of the invention, prestressing a beam is performed by an air or hydraulic piston.

According to some embodiments of the invention, the beam comprises a curved force carrying element.

According to some embodiments of the invention, the beam is attached to a pallet and placing load on the beam comprises placing load on the pallet.

According to an aspect of some embodiments of the present invention there is provided a beam for supporting a pallet for carrying load, the beam comprising:

a first elongated element comprising a force carrying element;

a second elongated element positioned below the first elongated element;

a gap between the first and second elements for receiving tines of a forklift; and a tension element attached along the second elongated element.

According to some embodiments of the invention, the first elongated element comprises a curved force carrying element.

According to some embodiments of the invention, there is provided a pallet for carrying load, comprising:

a plurality of beams according to the aspect above attached to a bottom surface of the pallet, between a corner and a center of the pallet.

According to some embodiments of the invention, at least one tension element is attached along two beams and through the center of the pallet, thereby reinforcing the beams.

According to some embodiments of the invention, there is provided a pallet for carrying load, comprising:

a plurality of beams according to the aspect described above diagonally attached to a bottom surface of the pallet.

According to some embodiments of the invention, the beam is prestressed before attachment of the tension element.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
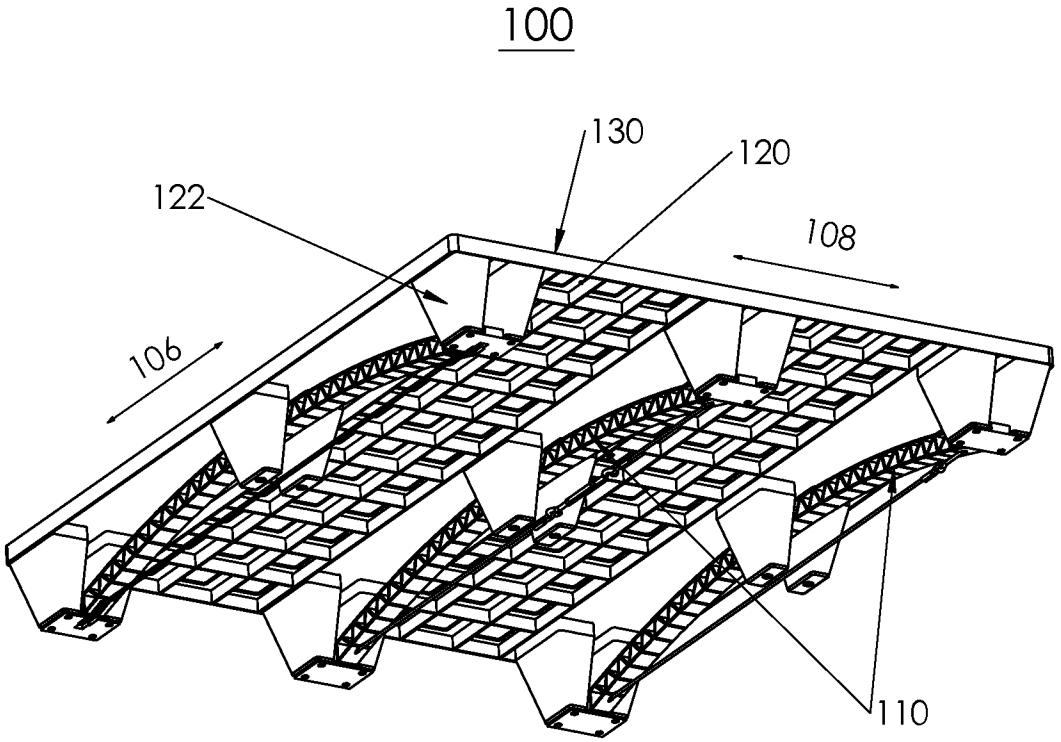
FIGS. 1A-1D are schematic illustrations of bottom and side views of a pallet with beams according to some embodiments of the invention.

The present invention, in some embodiments thereof, relates to carrying loads and, more particularly, but not exclusively, to pallets and beams for carrying loads.

An aspect of some embodiments of the invention relates to a pallet having at least one supporting element, hereinafter referred to as a beam, wherein at least a portion of the beam has a curved force carrying element.

A "curved force carrying element" as used herein refers to a curved element, for example in order to pass compressive forces along the curve. In some embodiments, the curved force carrying element has the shape of a curved arch, optionally a two dimensional arch, or a section of a dome. The curved force carrying element is also referred herein as an arched element.

An aspect of some embodiments of the invention relates to a pallet with beams which is adapted to be placed on racks and carry significantly more load than ordinary pallets having the same weight or than the same pallet without beams. In an exemplary embodiment of the invention, the pallet is adapted to carry at least between 100-200 kg, between 100-150 kg or between 120-200 kg of load for each 1 kg of raw material of the pallet, when placed on racks. For example, a pallet can carry at least about 140 kg, 150 kg or 160 kg of load when placed on racks, for each 1 kg of raw material. For example, a pallet having a weight of about 6.5 kg can carry about 1 ton of load or more.

"Racks" as referred herein relates for example to at least two parallel racks on which pallets are placed for storage. When placed on racks, a pallet is typically only supported at two parallel edges of the pallet. The racks do not support the center and other edges of the pallet. Generally, beams of a pallet are positioned perpendicular to the racks and increase the load that the pallet can carry by providing support to the pallet between the two supported edges. The term "racked" refers to a pallet that is placed on two parallel racks.

In some embodiments of the invention, the pallet comprises an upper surface on which load is placed and a bottom surface to which at least one beam is attached. Optionally, the upper and bottom surfaces form a substantially flat surface. Alternatively, at least one of the upper and bottom surfaces has a raised form.

The beam optionally comprises two support elements at its ends and an arched element along its length between the support elements. The support elements optionally support the bottom surface of the pallet and contact a surface on which the pallet is positioned. Optionally, the support elements also provide a connection between the arched element and the pallet. The arched element is positioned such that load placed on the pallet will be substantially perpendicular to the longitudinal axis of the arch. In some embodiments, load is placed on the extreme point or points of the arch.

In some embodiments, the arched element consists of at least two arched elements positioned one under the other, for increasing the strength of the beam. Optionally, the two arched elements are substantially parallel to each other. Alternatively, the two arched elements have different curves. A truss may be positioned between the two arched elements. Optionally, the truss has substantially the same length as the arched elements. Alternatively, the truss is shorter than the arched elements and one or more trusses are optionally positioned at the point or points on which load is placed, thereby saving material and weight of the pallet. Optionally, the truss is in the form of a line that sharp turns first to one side then to the other, hereinafter referred to as a zigzag.

In other embodiments, the arched element is a continuous piece with an arched shape bottom surface and an upper surface which conforms to the shape of the pallet. Optionally, the arched element has multiple sequential arches at its bottom surface. Alternatively, when the bottom surface of the pallet has a raised structure, the arched element may have a substantially straight bottom surface and conform to the raised structure of the pallet at the upper surface of the arched element.

The arched element tends to stretch outwards when load is placed on the pallet. In some embodiments, one or more tension elements such as cables are provided between two ends of the arched element in order to resist flattening of the arched structure when load is provided. The cable(s) provide tensile strength and substantially increase the load that can be carried by the pallet without flattening of the arched element. Optionally, the cables allow the arched element to deflect by less than 30%, 40%, 50% or 60% when load is placed on the pallet. The cables are optionally positioned at the inner side of the arch. Optionally, the cables are positioned such that the cables do not contact a surface on which the pallet is positioned in order to prevent wear of the cables due to rubbing with the ground, racks or other surface on which the pallet is positioned.

In some embodiments the cables are positioned along the length of the arched element and do not interfere with a forklift that fits between the beams and lifts the pallet.

In some embodiments, the arched elements are prestressed by between 50-200 kg tensile strength by tightening the cables to the desired tensile strength, for example the cables are stressed to about 100 kg, 150 kg or 200 kg tensile strength and also maintain a curvature of the arch when load is placed on the pallet. Alternatively, the arched elements are prestressed by bending the arch, for example by an air or hydraulic piston, and the cable is then attached along the length of the arch in order to maintain a curvature of the arch when load is placed on the pallet.

In some embodiments, the cables are attached to the arched element by screw-nuts or the like. In these embodiments, the arched element should be prestressed before attaching the cables. In other embodiments, the cables are attached by hook and loop means or turnbuckles. In these embodiments, the cables can be first attached to the arched element and then tightened to the desired tensile strength by turning the nut on the hook or turning the turnbuckle.

In some embodiments, the cables are made of steel. Optionally, when the straps that secure the load to the pallet are made of steel, cables may not be required and the straps may provide the necessary tensile strength. Optionally, the steel straps provide tensile strength in addition to the cable(s).

In some embodiments of the invention, cables are provided on some of the beams of the pallet, while other beams have no cables. Alternatively, all the beams of a pallet are provided with at least one cable or strap.

In some embodiments, the beam is positioned along the length and/or width of the pallet. Optionally, two beams are positioned at the ends of the pallet. One or more additional beams may be positioned along the pallet. Optionally, all beams are positioned substantially parallel to each other enabling a forklift to fit between the beams and lift the bottom surface of the pallet and transfer the load. A standard forklift according to some embodiments of the invention is about 100-150 mm width, about 40-50 mm thick and about 80-2500 mm long.

Optionally, the beams take up between about 10%-20% of the bottom surface of the pallet, for example about 10%, 12% or 15% of the bottom surface of the pallet.

In some embodiments, the beams are positioned diagonally between two opposite ends of the pallets. Optionally, the beams form a star configuration at the bottom surface of the pallet.

In some embodiments, one or more of the beams comprise two elongated elements positioned one beneath the other with a gap between the elements. In some embodiments, the gap is structured so as to enable tines (or forks) of a standard forklift to pass through the gap and lift the pallet to which the beams are attached. In some embodiments, the beams are attached to a curved pallet and the upper elongated element conforms to the curved shaped of the pallet. In some embodiments, the beams provide support for the pallet when positioned on a rack, for example three parallel beams are provided, two at two opposite ends of the pallet and one in between the two other beams.

When the pallet is placed on a rack, the beams are substantially perpendicular to the racks and support the bottom surface of the pallet at the two edges which are not placed on the racks and at the center of the pallet. In these embodiments, the beams significantly increase the load that can be carried by the pallet when racked. Optionally, the beams increase the load that can be carried by a racked pallet by between 200%-600%, for example, by 300%, 400% or 500%.

In some embodiments, the beams are integrally attached to the pallet. Optionally, the beams cannot be removed after attachment without causing damage to the pallet and/or beams. Alternatively, the pallet and beams are formed together of one piece, for example by injection molding. In these embodiments, the upper surface of the pallets may have indents for receiving beams of another pallet and saving stacking space.

In other embodiments, the beams are removably attached to the pallet, for example by screws, rivets or snap-ins. In these embodiments, the beams may be removed for example when stacking or shipping the pallets and may be re-attached for example when loading or racking the pallet.

In some embodiments of the invention, the beams are attached to the pallet by inserting the support elements into matching geometries on a bottom surface of a pallet. Alternatively, the beams are attached by one or more of screws, rivets, tacks, nails, welding, glue and snap-ins.

An aspect of some embodiments of the invention relates to a retrofit beam or set of beams for pallets. Pallets may be reinforced by attaching one or more beams to the bottom surface of an existing pallet. The beam(s) according to this aspect may be similar to the beams described with respect to the aspect above and may reinforce the pallet in similar ways.

In some embodiments, the force carrying element of the retrofit beams is not curved as above but acts like an arch in that the forces from the load are resolved into compressive stresses and push the force carrying element outwards. For example, the force carrying element can have a shape of a triangular truss.

In some embodiments of the invention, the retrofit beam(s) are secured to feet of the pallet by, for example, one or more of screws, rivets, tacks, nails, glue and snap-ins. Optionally, the retrofit beam(s) are removably attached to the pallet so that the beam(s) can be removed when stacking or shipping, thereby saving storage space. Alternatively, the retrofit beams cannot be removed from the pallet after attachment without causing damage to the beams and/or pallet.

In some embodiments, the beams have substantially the same length as the length of a side of an ordinary pallet. For example, a beam can have a length of between about 90-140 cm or between 100-120 cm such as 113 cm or 120 cm. Alternatively, the beams may be shorter or longer than the sides of some pallets used in the art. For example, the beams may have a length of a diagonal of a pallet and be attached diagonally to a pallet or the beams may have half of the length or less of a diagonal of a pallet and be attached between a corner and a center of a pallet. For example, a beam may have a length of between about 80%-100% of a diagonal of a pallet.

This may affect the support provided for the pallets on racks but should not affect the support provided by the beams to the pallet during other uses.

An aspect of some embodiments of the invention relates to a standalone beam or set of beams that can be directly attached to a load, such as a big-bag, box or bundle, without using a pallet for shipping and racking the load. In these embodiments, there is a structural synergy between the load and the beam(s) and the beams provide the necessary support for shipping or racking the load, without requiring a pallet that supports substantially the entire bottom surface of the load. In some embodiments, two or three beams are attached to the load, thereby enabling the load to be racked without requiring a pallet. In some embodiments, the beam(s) include support elements and/or a curved force carrying element and/or tension elements as described in the aspects of the invention above. Optionally, the force carrying element is not curved as described regarding the retrofit beam above.

In some embodiments, for example when the force carrying element is curved, a flat surface may be provided on the force carrying element for providing a structural synergy between the load and the beam. Optionally, the flat surface consists of one or more ribs. Optionally, the flat surface is provided only at the extreme point or points of the curved element. Optionally, for example when the bottom surface of the load is not flat, the ribs may form a flat surface which is wider than the force carrying element. Alternatively, the ribs form a flat surface which has substantially the same width as the force carrying element on which the flat surface is positioned.

Optionally, the pallet and beams are made of a same material or different materials having similar properties. In some embodiments, the pallet and/or beams are made of a material having flexural modulus of between 1200-1800 MPa and impact strength of between 4-5 $KJ/m^2$. Optionally, the pallet and/or beams are made from polypropylene and/or polyethylene.

Alternatively, the beams can be made of a stronger material than the pallet, for example a material having a flexural modulus of about 2,500 MPa and an impact strength of between about 20-35 $KJ/m^2$ such as Polycarbonate. In these embodiments, the beams are adapted to carry at least between about 200-300 kg or 250-300 kg of load for each 1 kg of raw material of the beams. For example a pallet supported by three beams of 1 kg each can carry at least about 1000 kg of load. Optionally, the pallet can be made of a recycled material.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1A schematically illustrates a pallet 100 with beams 110 according to some embodiments of the invention.

Pallet 100 includes a bottom surface 120 and an upper surface 130 on which load can be placed. In some embodiments, bottom surface 120 and upper surface 130 are two surfaces of one element. Alternatively, bottom surface 120 and upper surface 130 are two spaced apart elements. Bottom surface 120 and upper surface 130 are optionally substantially flat. Alternatively, at least one of the surfaces may have a raised form, for example an arched or dome form.

Pallet 100 includes a number of feet 122 for supporting bottom surface 120 of the pallet and enabling it to be lifted by a forklift. Pallet 100 can be used for carrying and shipping loads. In an exemplary embodiment of the invention, the pallet is reinforced by one or more beams 110 attached to bottom surface 120 and/or feet 122.

The beams according to some embodiments of the invention reinforce the pallet and enable it to carry more load. Optionally, the pallet with beams attached is adapted to carry substantially more load when racked than the same pallet without beams. For example, a racked pallet with one or more beams may carry between 200%-600% more load as opposed to the same racked pallet without beams. In addition, a racked pallet with one or more beams may carry between 200%-600% more load as opposed to other racked pallets having similar weight. For example, a pallet with beams can carry more than 200%, 300%, 400%, 500%, 600% more weight.

In an exemplary embodiment of the invention, the pallet with beams attached is adapted to carry at least between 100-150 kg or between 120-200 kg of load for each 1 kg of raw material of the pallet and beams, when placed on a rack. For example, a pallet can carry at least about 140 kg, 150 kg or 160 kg of load when placed on racks, for each 1 kg of raw material. For example, a racked pallet having a weight of about 6.5 kg can carry at least about 1 ton of load or more.

Bottom surface 120 refers to a bottom surface of an upper deck of the pallet. In some embodiments of the invention (not shown), one or more additional plates are provided under bottom surface 120, optionally under beams 110. Optionally, bottom surface 120 and upper surface 130 are surfaces of a same plate being about 3-6 mm thick. Optionally, the entire pallet with beams attached is about 8-20 cm high.

Figure 1B:
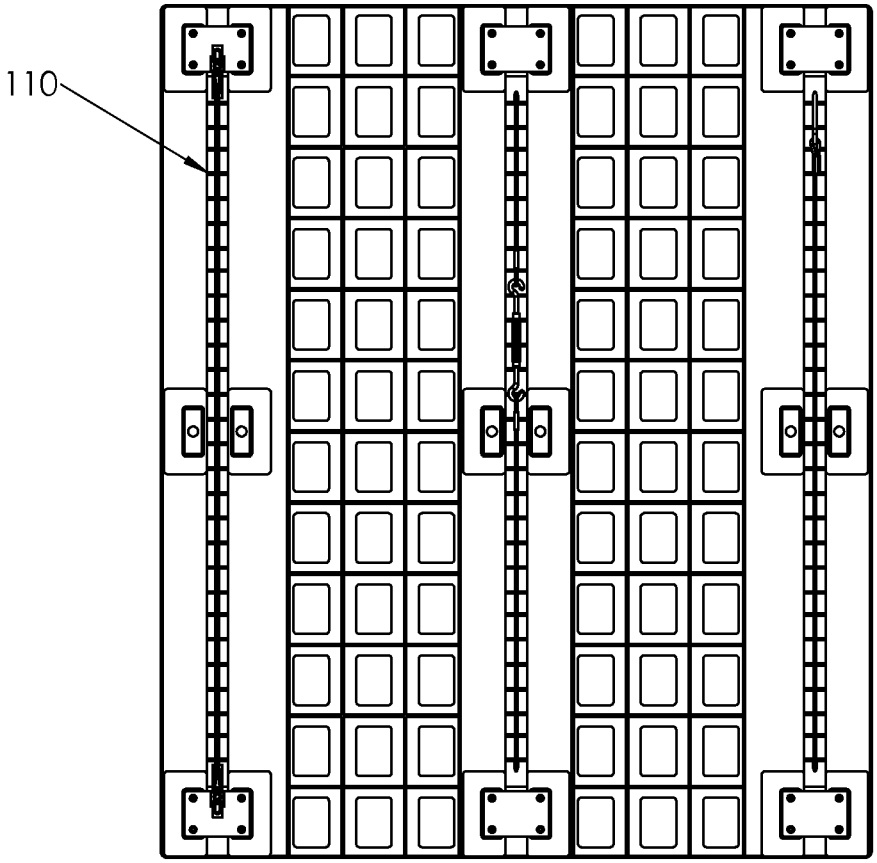
Figure 1C:
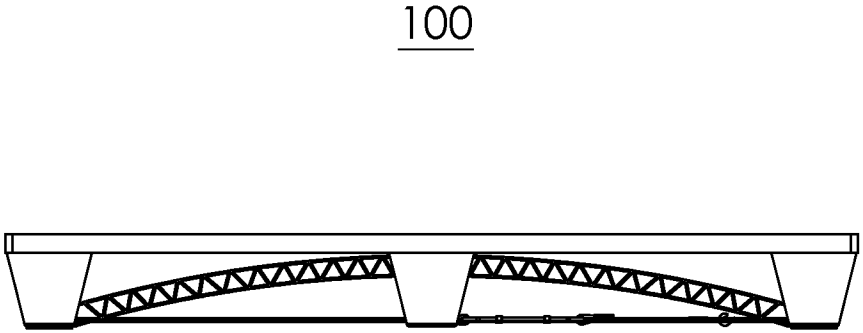
Figure 1D:
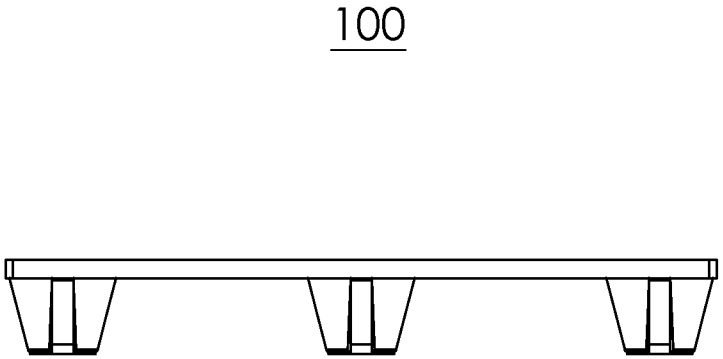

FIG. 1B schematically illustrates a bottom view of pallet 100 with beams 110 attached and FIGS. 1C and 1D schematically illustrate side views of pallet 100.

The beams may be attached along a length or width of the pallet. Optionally, pallet 100 is square shaped, for example of a size 113 cm×113 cm. Alternatively, the pallet is rectangular shaped, for example of a size 100 cm×120 cm. As used herein, the term length refers to the side illustrated by arrow 106 in FIG. 1A and shown in FIG. 1C and the term width refers to the side illustrated by arrow 108 in FIG. 1A and shown in FIG. 1D. The terms length or width are used for indicating a direction, however, these terms may be interchanged.

Pallet 100 is shown with three beams 110 in FIGS. 1A and 1B. It is noted that according to different embodiments of the invention, the pallet may have fewer or additional beams attached. For example 1, 2, 4 or 6 beams may be provided in accordance with embodiments of the invention.

The beams may be attached substantially parallel to each other as in FIGS. 1A-1D or in different directions, for example perpendicular to each other and may surround the circumference of pallet 100. In addition, the distance between beams 110 (when three or more beams are provided) may be equal or not.

Figure 1E:
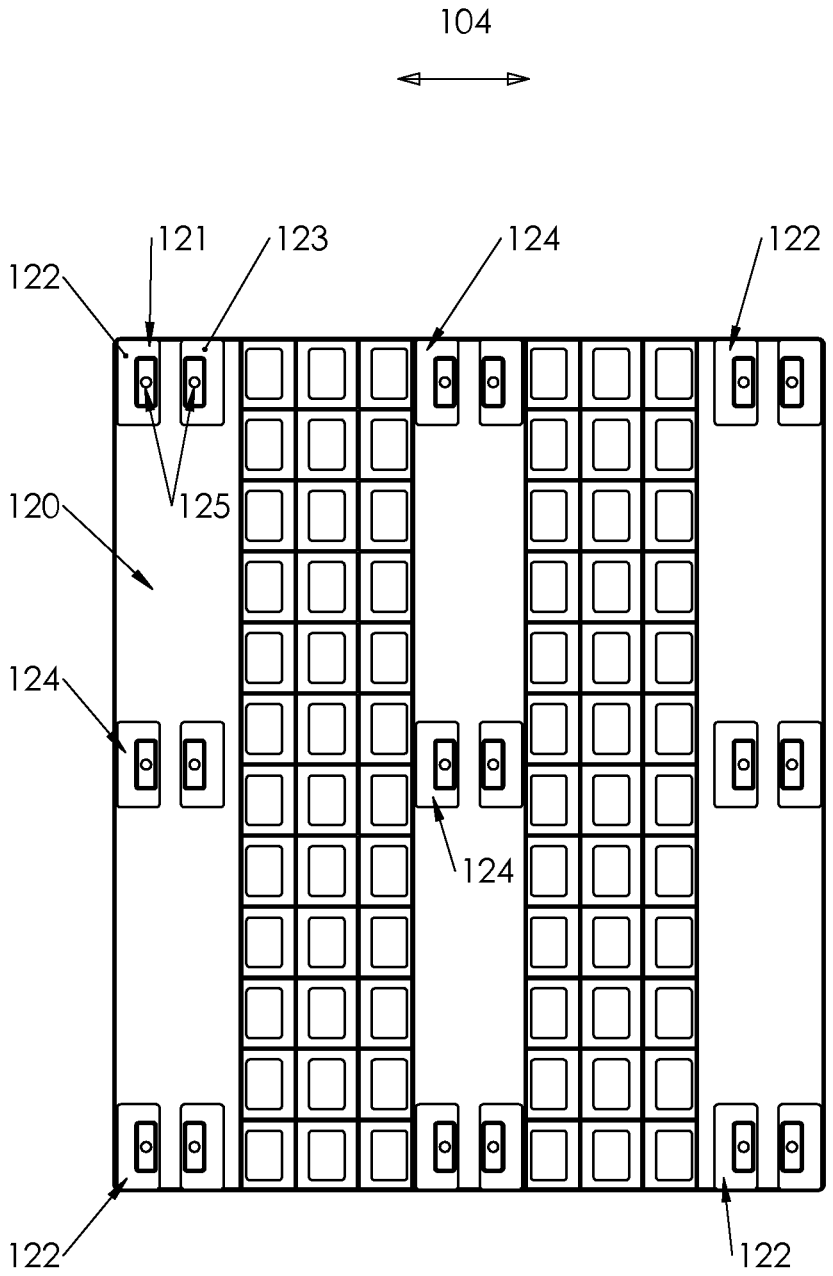
FIG. 1E is a schematic illustration of a bottom view of the pallet of FIGS. 1A-1D without beams attached.

The choice of the number, position and direction of the beams may be based on the use of the pallet, such as the amount of load placed on the pallet, if the pallet is to be lifted (by a forklift or other means), if the pallet is to be racked and/or where the pallet is intended to be placed. For example, at least three equally distanced beams may be attached to the pallet, thereby enabling the pallet to be supported by the beams when racked. FIG. 1G shows a pallet 100 positioned on racks 102. Alternatively, two beams may be sufficient for supporting a racked pallet, for example, by placing the beams each between a centerline and an edge of the pallet (such as between each two beams shown in FIG. 1A). For example, if pallets should be stacked on each other, the beams may be positioned such that the beams will fit into depressions in an upper surface of another pallet. In some embodiments, as for example shown in the side view of FIG. 1D, the attachment of the beams provides space at the bottom surface for a forklift to lift the pallet. The tines (or forks) of the forklift will thus be parallel to the beams, pass between the beams and carry the bottom surface of the pallet. For example, when an extremely heavy load is to be put on the pallet or when the pallet is not intended to be lifted by a forklift, the beams may be diagonally attached to the bottom surface. Alternatively, beams as shown in FIGS. 6A-C and 7A-B may be used. For example, when the load to be carried by the pallet is not substantially heavy, one beam may be sufficient and may for example be attached along a centerline of the pallet.

Figure 2A:
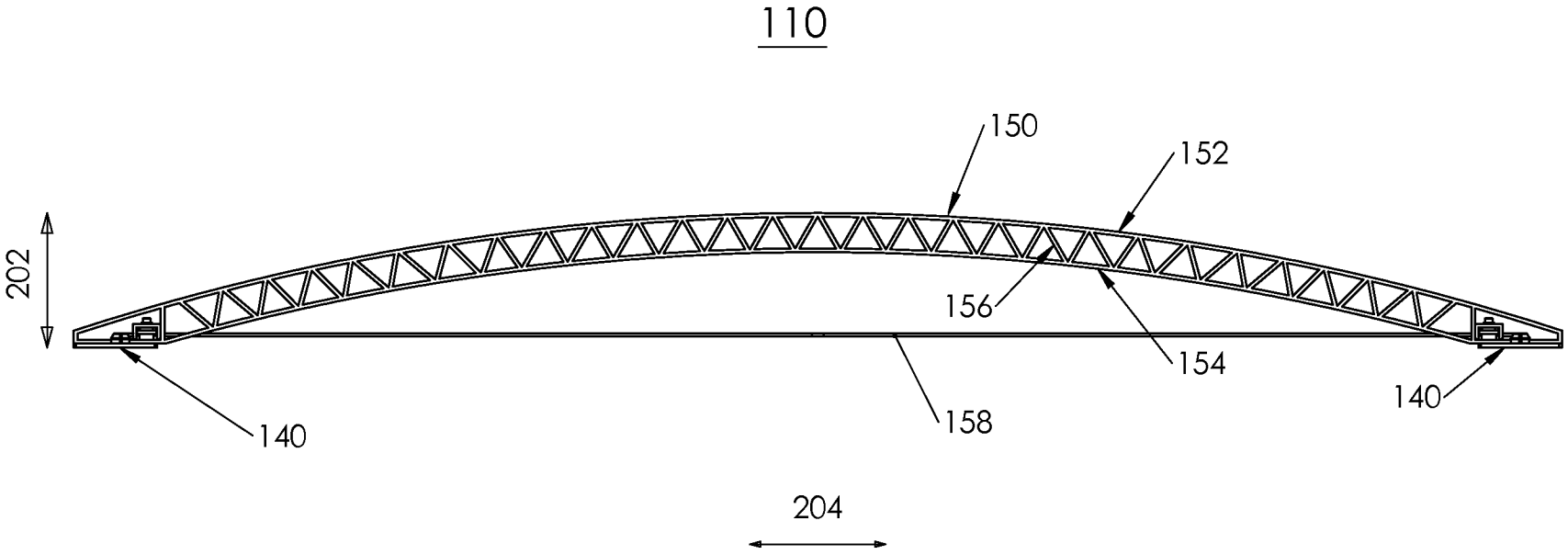
FIGS. 2A and 2B are schematic illustrations of side and upper views of a beam to be used with the pallet of FIGS. 1A-1F according to some embodiments of the invention.
Figure 2B:
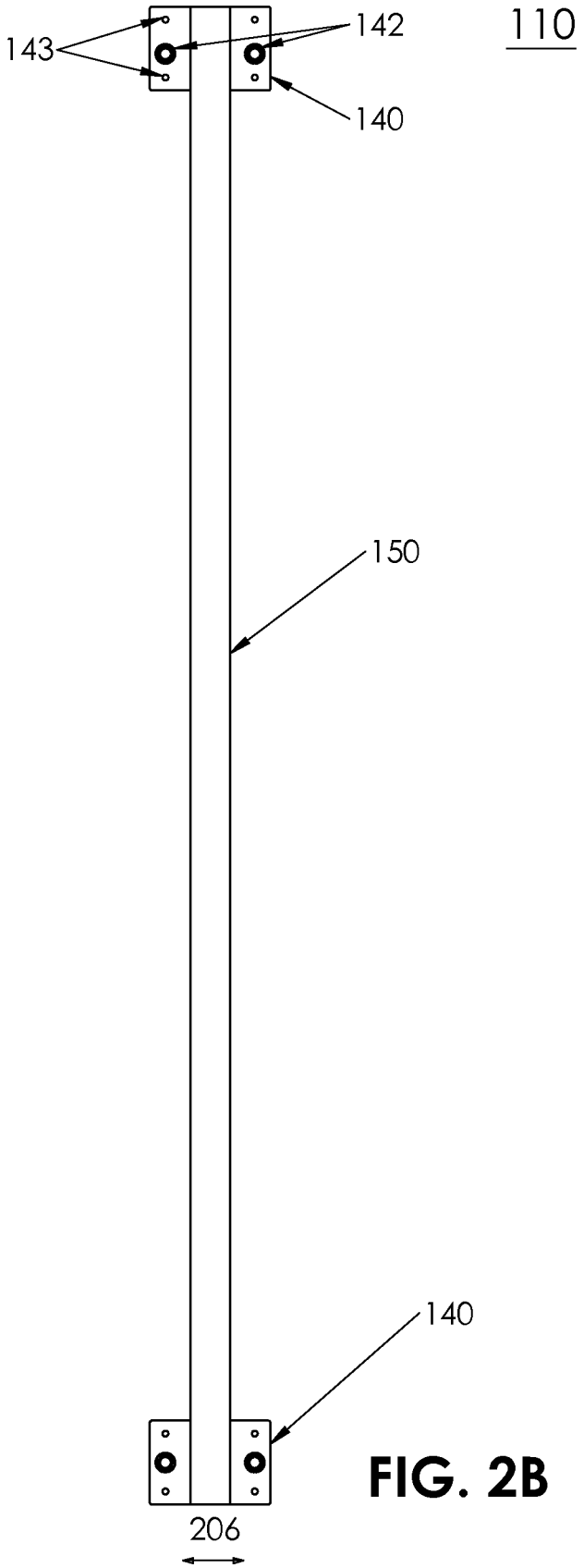

FIGS. 2A-2E are schematic illustrations of exemplary beams 110 in accordance with some embodiments of the invention. FIG. 2A is a side view of a beam 110 and FIG. 2B is an upper view of beam 110.

Beam 110 optionally comprises two support elements 140 at its ends and a curved force carrying element 150 between the support elements. Curved force carrying element is shown in FIGS. 1 and 2 in the form of a two dimensional curved arch and will be referred herein as an arched element. However, a curved force carrying element in accordance with other embodiments of the invention can have different shapes which pass the compressive forces along a curve, for example a section of a dome, sphere or a sequential arch.

In some embodiments, for example as illustrated, the beam is attached in a direction that the extreme point of the arch faces bottom surface 120 of the pallet and the support elements face the ground or other surface on which the pallet is positioned, for example an upper surface of another pallet when the pallets are stacked. Alternatively, the beam is attached in a direction that the support elements are attached to the bottom surface of the pallet and the extreme point of the arch faces the ground or other surface on which the pallet is positioned. Alternatively the arched element is in the form of a sphere such that one side of the sphere faces the bottom surface of the pallet and the other side faces the ground.

The attachment of beam 110 to bottom surface 120 according to an exemplary embodiment of the invention will be explained with reference to FIG. 1E which illustrates bottom surface 120 without beams attached. Bottom surface 120 includes at least four feet or four pairs of feet 122 at its corners in order to support the pallet. Optionally, as shown in FIG. 1E, additional feet 124 are provided between each two feet 122 and/or at the center of the pallet. A beam may be attached between two feet 122, as shown in FIG. 1B. Each foot 122 may comprise of two interspaced elements, 121 and 123, between which an edge of a beam can be inserted. In some embodiments, elements 121 and 123 each contain an indent 125 which geometrically matched a protrusion 142 on support element 140 (FIG. 2B). The beam can thus be attached to the pallet by snapping protrusions 142 into indents 125. Alternatively, support elements 140 can be attached to the pallet by, for example, screws, rivets, tacks and/or nails, for example through holes 143.

Optionally, arched element 150 is supported by intermediate foot 124 (FIG. 1E), preventing side movement of the beam in directions 104. The arched element can be inserted between two interspaced elements of foot 124. Alternatively, other means for supporting the arched elements are provided, such as screws, rivets, nails or the like. For example, in some embodiments, pallet 100 has a recess (not shown) for receiving the extreme point of arched element 150. Optionally, the recess is curved.

The beams are optionally removably attached to the pallet and may be removed for stacking the pallets one on the other, thereby saving stacking space. For example, by removing screws which attach the beams or by pulling the beam away from the pallet, thereby releasing protrusions 142 from within indents 125. Alternatively, the beams may be integrally attached to the pallet and cannot be removed from the pallet without causing damage to the pallet and/or beam, for example, when the beams are attached by welding or glue or when the beams are integrally formed with the pallet. In these embodiments the beams may be stacked with the pallets.

Figure 1F:
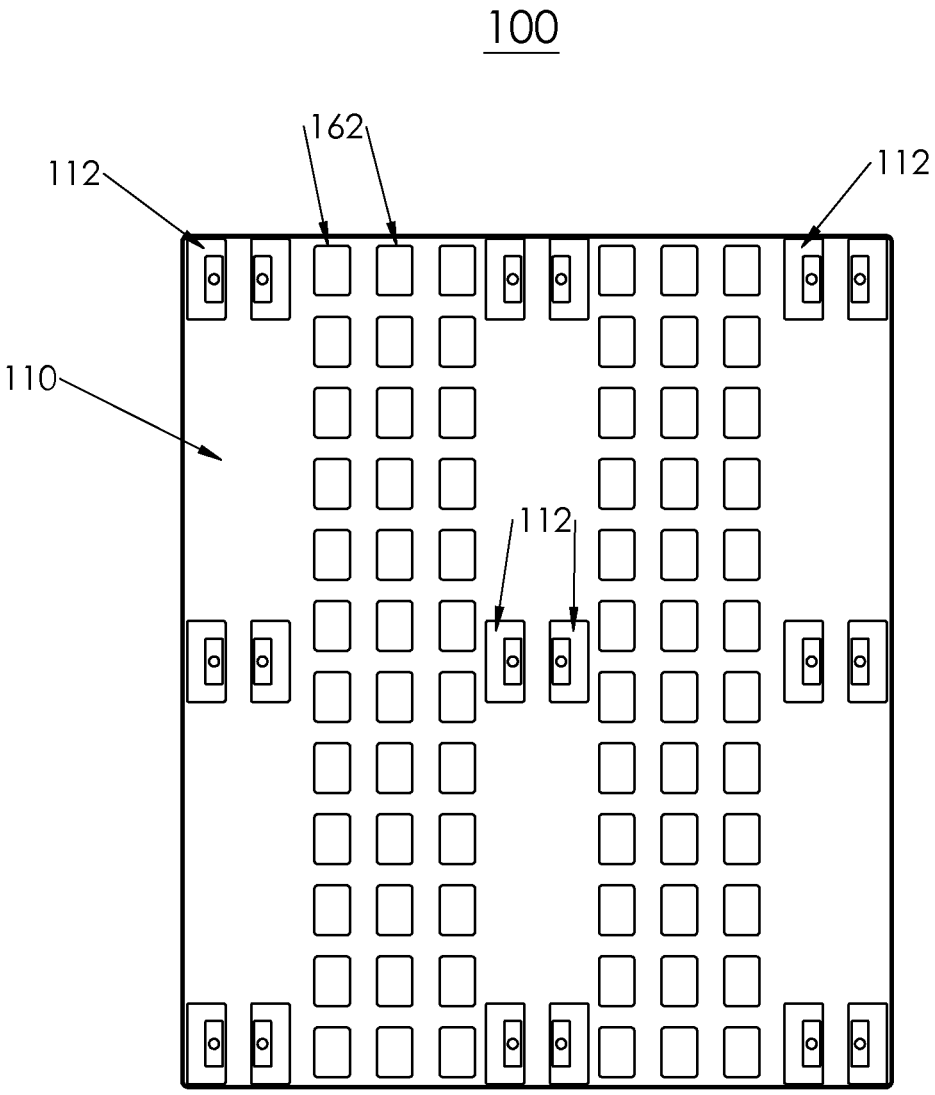
FIG. 1F is a schematic illustration of an upper view of the pallet of FIGS. 1A-1E.
Figure 1G:
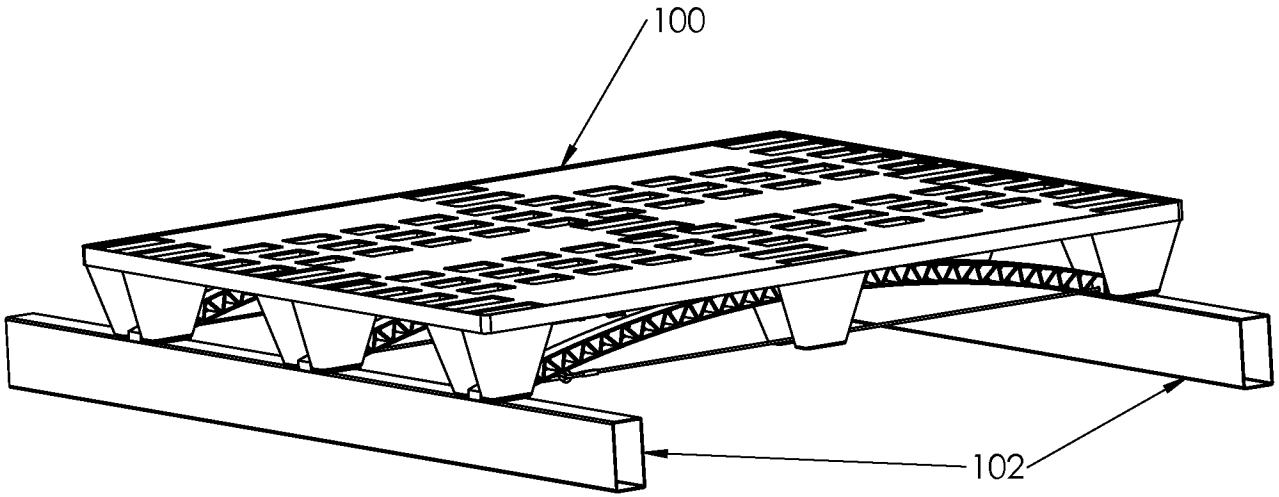
FIG. 1G is a schematic illustration of the pallet of FIGS. 1A-1F positioned on racks.

FIG. 1F is a schematic illustration of an upper view of pallet 100. Optionally, for example when the beams are removably attached to the pallet, upper surface 110 of the pallet comprises indents 112 for receiving feet 122 and/or 124 of another pallet, thereby saving stacking space. In some embodiments, the upper surface of the pallet may have additional openings or windows 162 in order to save material and weight of the pallet.

A detailed explanation of the beams' structure in accordance with some embodiments of the invention is now provided with reference to FIGS. 2A-2E.

Arched element 150 may be reinforced by providing two arched elements 152 and 154 positioned one under the other, for increasing the strength of the beam.

Optionally, as shown, the arched elements 152 and 154 are substantially parallel to each other. Alternatively, the two arched elements have different curves, for example, the arched element 152 may have a sharper curve than element 154. In addition, arched elements 152 and 154 are shown having the same width. In an alternative embodiment, arched element 152 is wider than arched element 154 and provides additional support to the pallet. Alternatively or additionally, element 152 is not arched as shown but is substantially flat.

A truss 156 is optionally positioned between elements 152 and 154. Optionally, for example as shown in FIG. 2A, truss 156 has substantially the same length as bowed elements 152 or 154. Alternatively, truss 156 can be shorter than elements 152 or 154 and may be positioned at the point of the arched elements which is closest to bottom surface 120.

In some embodiments, more than two arched elements are provided, for example three or more arched elements can be provided one under the other with a truss between each two elements. Generally, for some designs, increasing the height of the arched element, increases the weight the beam can support. However, a balance may be desirable between the amount of material and weight of the beam and the support necessary. Height is indicated by an arrow 202 in FIG. 2A. In some embodiments, the beam is between about 5-20 cm high, for example between about 5-10 cm, 8-20 cm, 10-18 cm or 12-15 cm high.

Optionally, as shown in FIG. 2A, truss 156 is in the form of a line that sharp turns first to one side and then to the other, hereinafter referred to as a zigzag. In some embodiments, the truss is between 1-5 mm thick, for example, 2, 3 or 4 mm thick. The direction of thickness of the truss as used herein is indicated by an arrow 204 in FIG. 2A.

Beam 110 is optionally at the same length as the length of pallet 100 and can be between about 90-140 cm long, for example between about 100-130 cm long, such as 113 cm or 120 cm long. Optionally, the width of the arched element, as indicated by arrow 206 in FIG. 2B is between about 3-15 cm, for example between about 5-12 cm.

In some embodiments, the beam is reinforced by providing one or more tension elements 158 to reinforce the arched element when load is placed on the pallet. Tension elements 158 will be referred herein as cables 158 but may in some embodiments be other tension elements such as for example steel rods. In some embodiments, tension elements 158 strengthen the beam, thereby enabling the pallet to carry substantially more weight than ordinary pallets in the art having the same weight.

Cable(s) 158 are connected between the two edges of the arched element and provide tensile strength, thereby resisting flattening or spreading of the edges of the arched structure when load is placed on the pallet and substantially increasing the load that can be carried by the pallet.

Cables 158 are optionally positioned at the inner side of the arch so as to maintain a curvature of the arch when load is placed. Optionally, the cables are positioned such that the cables do not contact a surface on which the pallet is positioned, in order to prevent wear of the cables due to rubbing with the ground or other surface.

In some embodiments, the beams are prestressed to between 50-200 kg tensile strength, for example about 100 kg, 150 kg or 200 kg tensile strength. Optionally, the beams are first prestressed by bowing the curved element and the stress is preserved by attaching a cable. Alternatively, the cables are first attached to the beams and the beams are then prestressed by tightening cable 158 to the desired tensile strength.

Optionally, cables 158 are shorter than the distance between the edges of the arched element, to which the cable is attached, before the beam is prestressed. For example, the cable may be about 0.5%, 1% or 2% shorter than the distance between two edges of a beam before prestressing. For example, cable 158 may be about 1 cm shorter than the distance between two edges of the beam to which the cable is attached.

In some embodiments, the beams with tension element(s) may deflect to some degree when load is positioned on the pallet. For example, the beam may deflect by up to 2 cm. For example, the curve of the arched element may straighten by about 40%, 50% or 60% when load is placed on the pallet.

Optionally, cables 158 are made of steel. Alternatively, cables 158 are made of suitable polymer materials which can provide the desired tensile strength in order to preserve a stress of the beam.

Figure 6A:
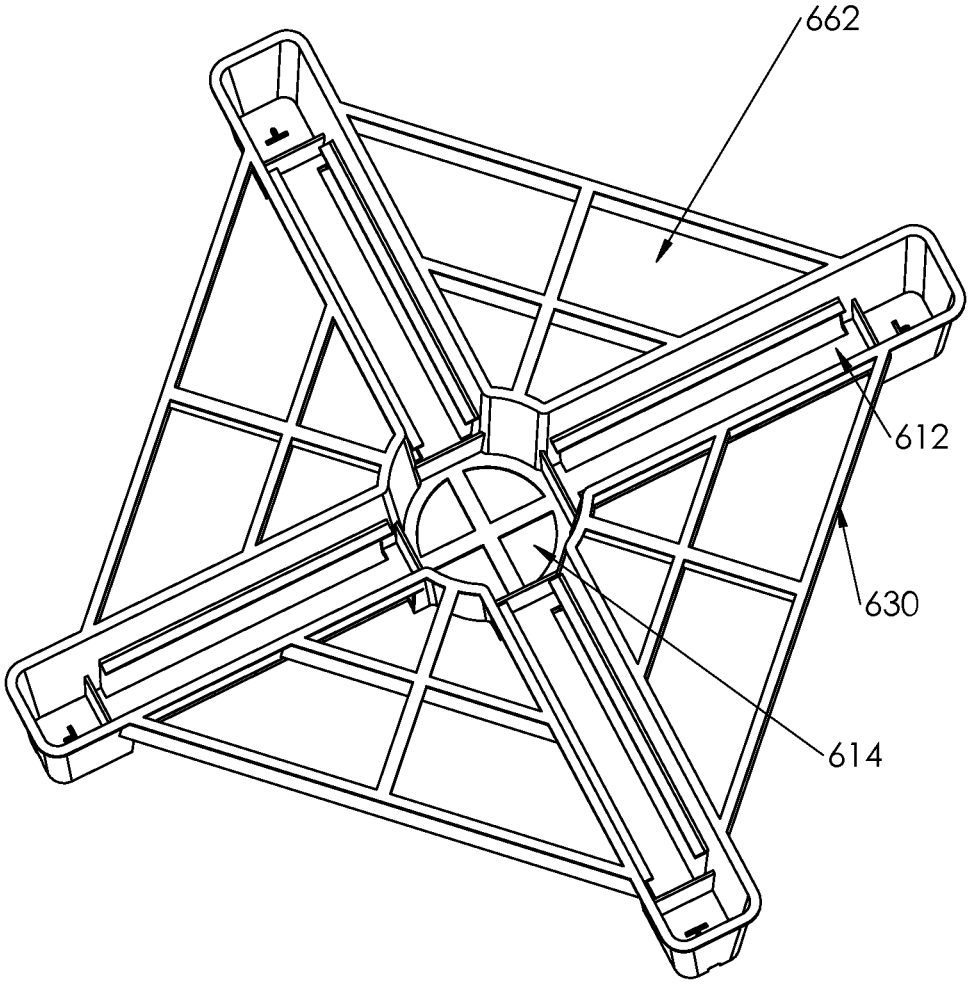
FIGS. 6A-6C are schematic illustrations of a pallet and beams according to other embodiments of the invention.
Figure 6B:
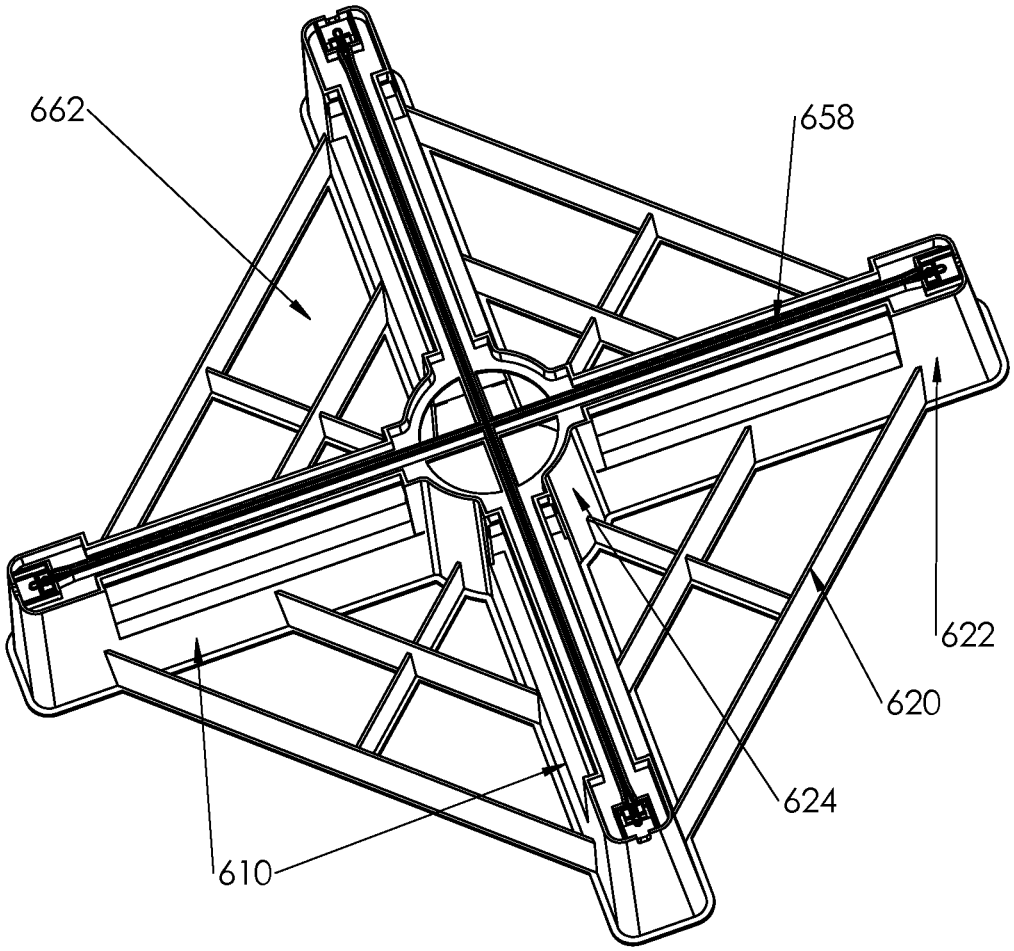
Figure 6C:
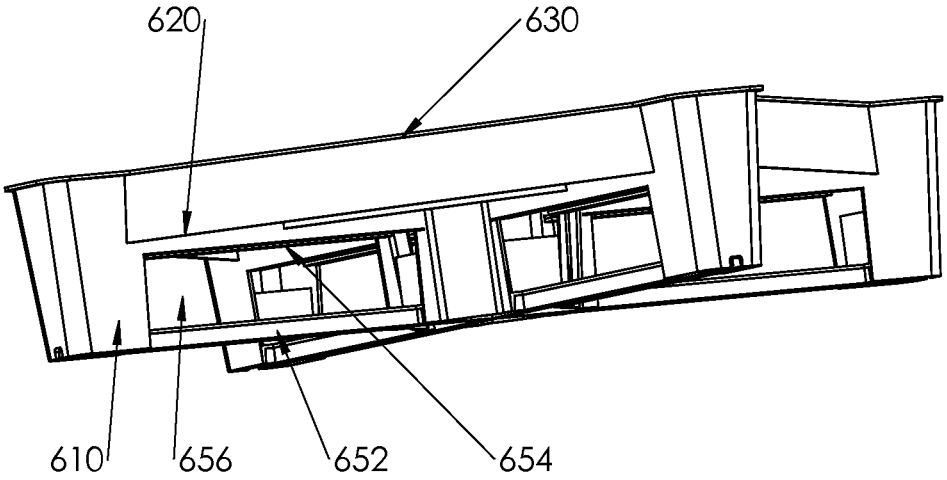

FIGS. 6A-6C schematically illustrate beams in accordance with other embodiments of the invention. FIG. 6A shows an upper view of a pallet 600 and FIG. 6B is a bottom view of pallet 600 showing beams 610 attached.

Pallet 600 may have dimensions of an ordinary pallet, for example being about 150-300 mm high and having a square form of about 1000×1000 mm or 1200×1200 mm, or having a rectangular form of about 800×1200 mm or 1000×1200 mm.

Pallet 600 includes an upper surface 630 shown in FIG. 6A and a bottom surface 620 shown in FIG. 6B. Beams 610 are attached to bottom surface 620. FIG. 6B shows beams 610 in a diagonal direction, whereby each beam is attached between a corner 622 of the pallet and a center 624 of the pallet. Two beams 610 attached along a same diagonal of the pallet are referred to herein as continuing beams. Center 624 comprises a meeting or attaching point for all the beams and/or between the pallet and the beams.

Center 624 is optionally circle shaped as shown or in the shape of a polygon. For example, center 624 can have the shape of a square, each side of the square defining an end of a beam. Optionally, center 624 extends along the entire height of the pallet.

In other embodiments, a beam may extend through a diagonal of a pallet, being attached to two corners of the pallet, whereby center 624 is defined as the meeting point of two diagonal beams.

FIG. 6C is a side view of pallet 600 with beams 610. Each beam 610 includes two elongated elements 652 and 654 positioned one under the other, such that a gap 656 is provided between the elongated elements. In some embodiments, tines (or forks) of a forklift may be inserted through gap 656 thereby enabling pallet 600 to be lifted from either side thereof. Gap 656 is optionally between 100-200 mm high (distance between elements 652 and 654). Optionally, gap 656 is between 120-180 mm or about 150 mm high.

Attaching beams in a diagonal direction to a bottom surface of the pallet may provide support for the pallet when lifted by a forklift (or other means). In the embodiments shown in FIGS. 6A-6C, the forks lift the pallet through the beams, thereby enabling the beams to support the pallet when lifted and held by two forks only. Element 654 is optionally between 3-6 mm thick to support the forks. The beams will further support the pallet when racked or placed on other surfaces.

In an exemplary embodiment of the invention, elements 654 and 652 act as force carrying elements. Optionally, elements 652 and 654 have substantially the same length. Although both elements 652 and 654 are shown as flat shaped (not curved), force carrying elements 652 and 654, act like an arch in that the forces from the load are resolved into compressive stresses and push the arch outwards, away from the pallet. Element 652 also acts as a tension element and assists in maintaining a shape of element 654 when load is positioned on the pallet. In some embodiments, element 654 is compressed while element 652 is stretched when the pallet is loaded.

Figure 7A:
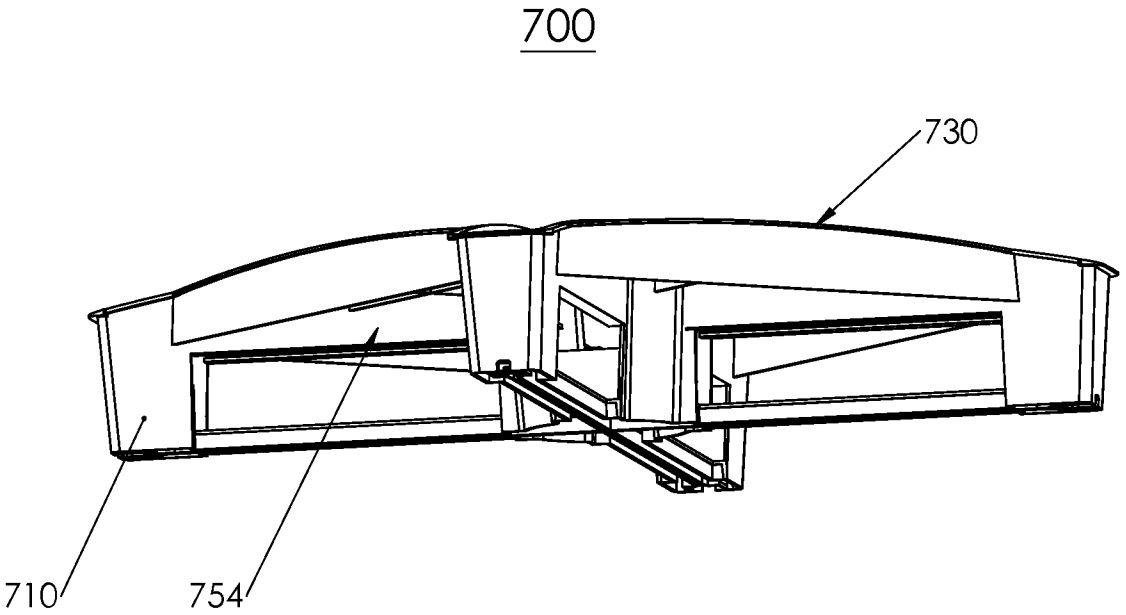
FIGS. 7A and 7B are side and bottom view of a pallet and beams according to yet other embodiments of the invention.
Figure 7B:
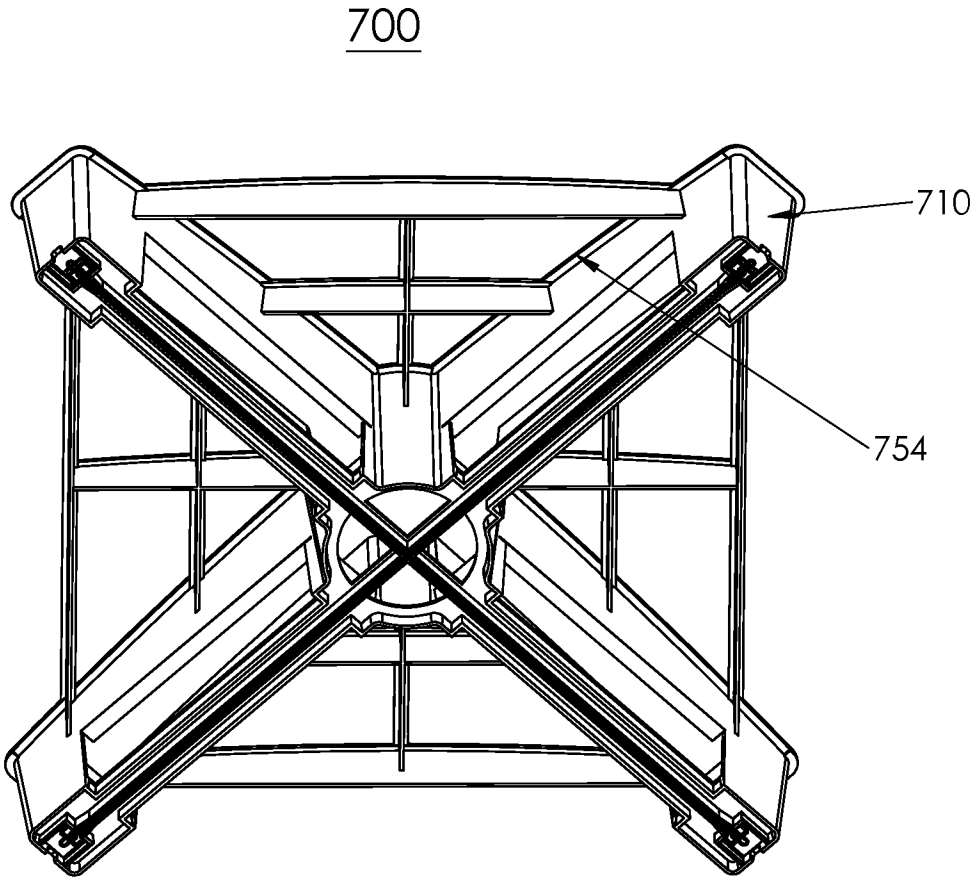

In other embodiments, element 654 has a curved shape, or the shape of half a curve. FIGS. 7A and 7B for example are side and bottom views of a pallet 700, having an upper surface 730 which is in the shape of a dome. Accordingly, an upper element 754 of a beam 710 is in the shape of half a curve conforming to the shape of upper surface 730 between a corner and center of the pallet. Upper elements 754 of two continuing beams 710 thereby form the shape of a curve. The other elements of pallet 700 and beams 710 are similar to pallet 600 and beams 610 described with respect to FIGS. 6A-6C herein.

Beams 610 are optionally integrally formed with pallet 600, for example the pallet and beams can be made by injection molding, compression molding or otherwise non-removably attached. In other embodiments, beams 610 may be removably attached to the pallet, thereby enabling the beams to be removed from the pallet without causing damage to the pallet or beams, by attaching means to corners 622 and/or center 624 of the pallet.

In some embodiments, beams 610 (or 710) are reinforced by tension elements 658, which may be similar to cables 158 described above. Optionally, a cable 658 (or 758 in FIG. 7B) is extended along two continuing beams 610 through center 624, as shown in FIG. 6B. In other embodiments, a cable is connected along each beam separately. Connecting a cable between two opposite corners of a pallet may provide better reinforcement for the pallet when racked.

Pallet 600 optionally further comprises openings or windows 662 for saving material and weight of the pallet. Optionally, openings 662 comprise at least 50% of the area of upper surface 630 of the pallet.

In some embodiments, upper surface 630 (FIG. 6A) includes indents 612 for receiving beams of another pallet when stacked, thereby saving stacking space. An indent 614 may also be provided at the center of the pallet for receiving the center of another pallet when stacked.

Various attaching and/or tightening means for cables are provided according to embodiments of the invention, for example as described in FIGS. 2C-2H below. The beams of FIGS. 2C-2H resemble the beams of FIGS. 2A and 2B, however, in some embodiments of the invention, the same method and structure may be used with other beams, such as beams 610 and 710 shown in FIGS. 6A-6C and 7A-7B with the necessary changes. In some embodiments, when cables are attached to beams of FIGS. 6 and 7, a cable is attached to two continuing beams positioned along a diagonal of a pallet and the description of prestressing a beam or two ends of a beam refer to prestressing two continuing beams and an end of a first beam and an end of a second beam.

Figure 2C:
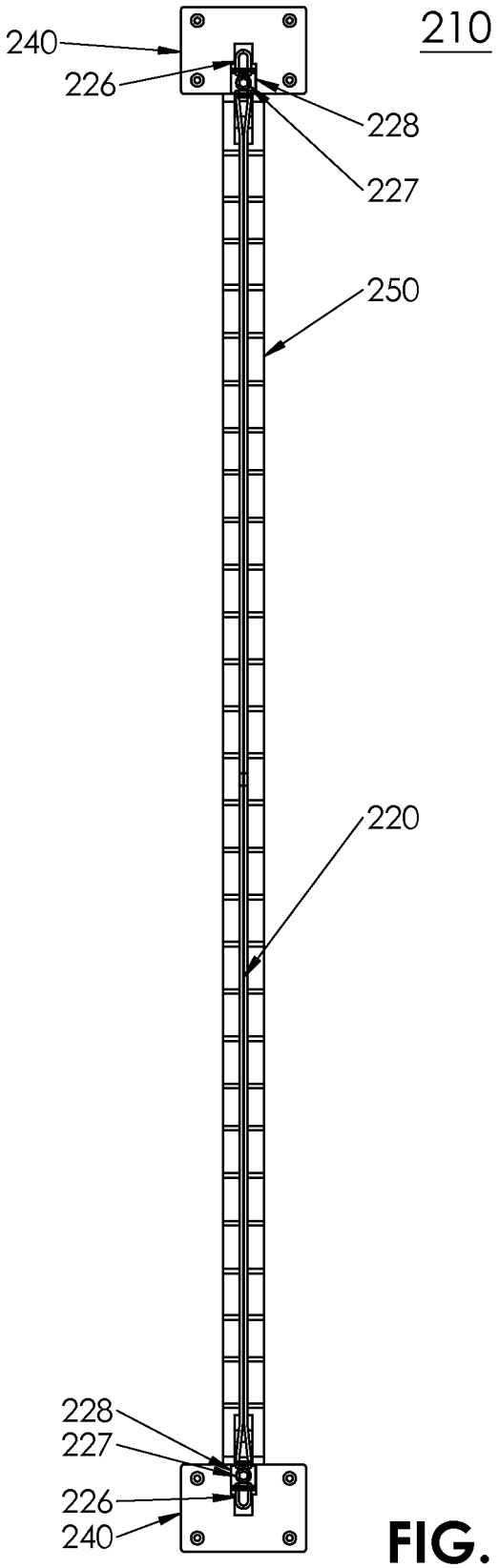
FIGS. 2C-2H are schematic illustrations of bottom and side views of cables and their attachment means to the beam of FIGS. 2A and 2B in accordance with different embodiments of the invention.
Figure 2D:
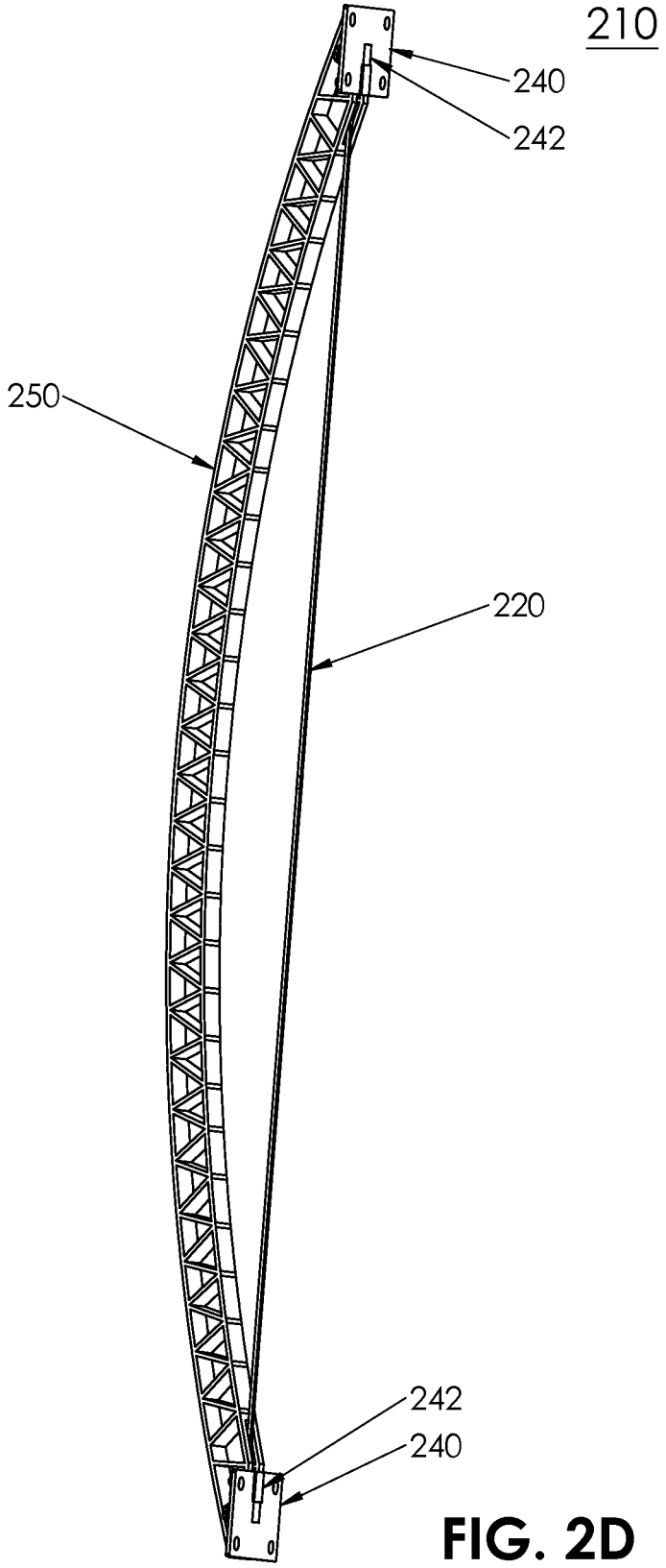

FIGS. 2C and 2D schematically illustrate one embodiment of the invention where a cable is attached to a beam. Optionally, in this embodiment the beam is first prestressed and the cable is then attached in order to preserve the stress of the beam. FIGS. 2C and 2D are bottom and side views of a beam 210 with a cable 220.

Beam 210 has two support elements 240 and an arched element 250 similar to the beams described with respect to FIGS. 2A and 2B above. Cable 220 for example includes two loops 226 at its ends. Each loop is positioned on an anchor 227 and fastened with a clamp 228 to beam 210. Cable 220 is generally slightly shorter than the distance between two anchors 227, for example about 1 cm shorter. Therefore, the beam is first prestressed by bending the beam for example with an air or hydraulic piston or other means known in the art. Optionally, between about 50-100 kg is required to prestress the beam. The cable is then attached to the prestressed beam by attachment of the loops to the hooks and fastening the cables in place with clamps 228. The cable preserves the stress of the beam.

Support elements 240 are arranged with slots 242 in their center through which the cables and clamp pass. Thereby, the cables do not touch a surface on which the beam is positioned. It is noted that loops 226 and anchors 227 can be replaced with other attachment means known in the art, such as a stop sleeve on the end of the cable as shown in FIG. 2F and detailed below.

Figure 2E:
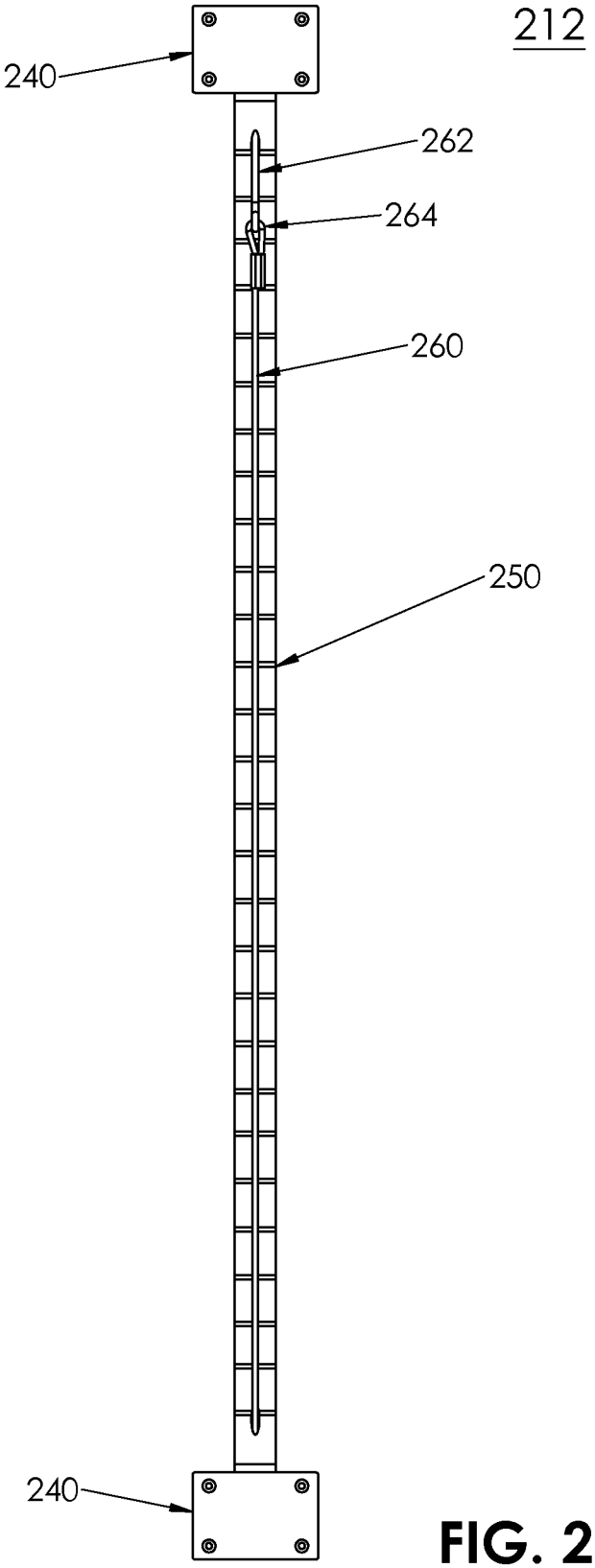
Figure 2F:
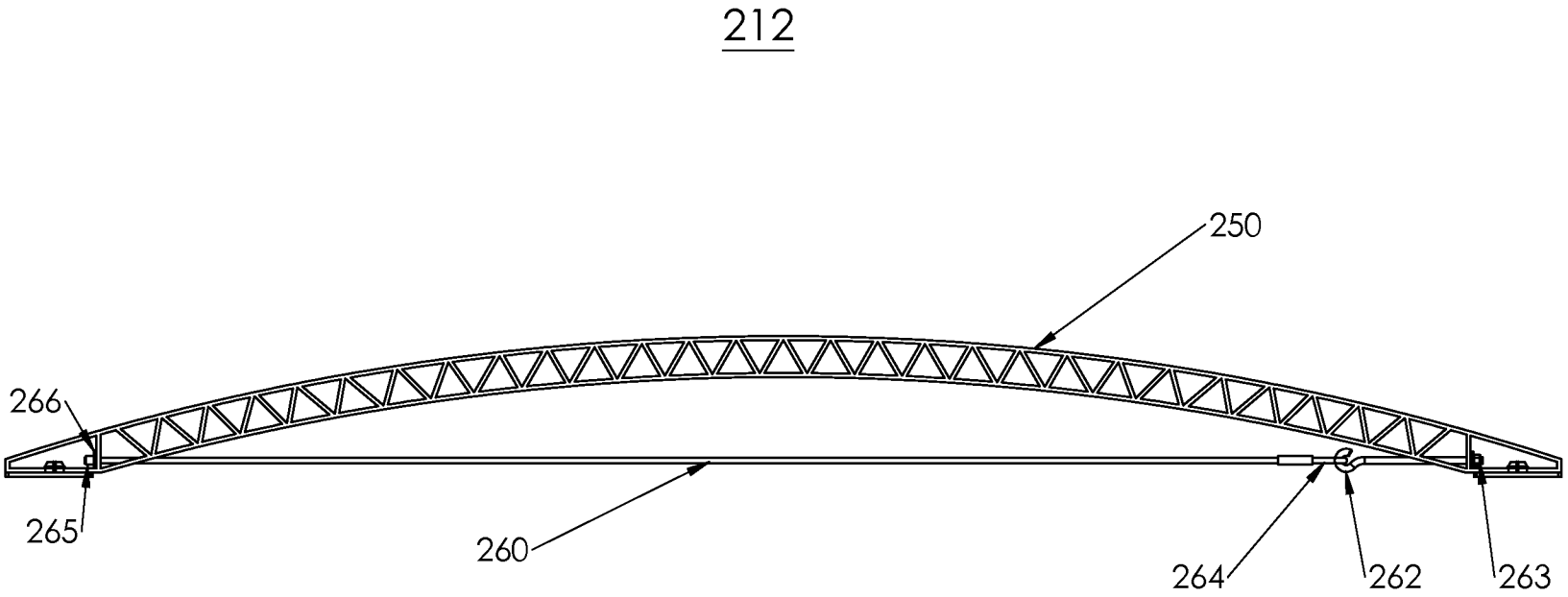

FIGS. 2E and 2F schematically illustrate another embodiment of the invention where a cable is attached to a hook. Optionally, in this embodiment, the cable is first attached and then assists in prestressing the beam. FIGS. 2E and 2F are bottom and side views of a beam 212 with a cable 260.

Beam 212 includes support elements 240 and an arched element 250 similar to the beams described with respect to FIGS. 2A and 2B above. Beam 212 includes a hook 262 and a cable 260. Hook 262 is attached at one end of arched element 250 and cable 260 is attached to another end of arched element 250. Hook 262 is optionally attached to the arched element by a nut 263. Cable 260 is attached to the arched element for example by a crimped stop sleeve 265, which is held by a slotted bracket 266. Other attachment means, such as a loop and anchor shown in FIG. 1D may be provided according to embodiments of the present invention. Cable 260 further includes a loop 264 attached to hook 262. Loop 264 is optionally first attached to hook 262, after which nut 263 is tightened, thereby stretching the cable to the desired tensile strength and prestressing the beam. Alternatively, the beam is first prestressed by bending arched element 250 and then the loop is attached to the hook and/or the nut is tightened.

Hook 262 and cable 260 are attached to arched element 250 and therefore do not contact a surface on which the beam is positioned.

Figure 2G:
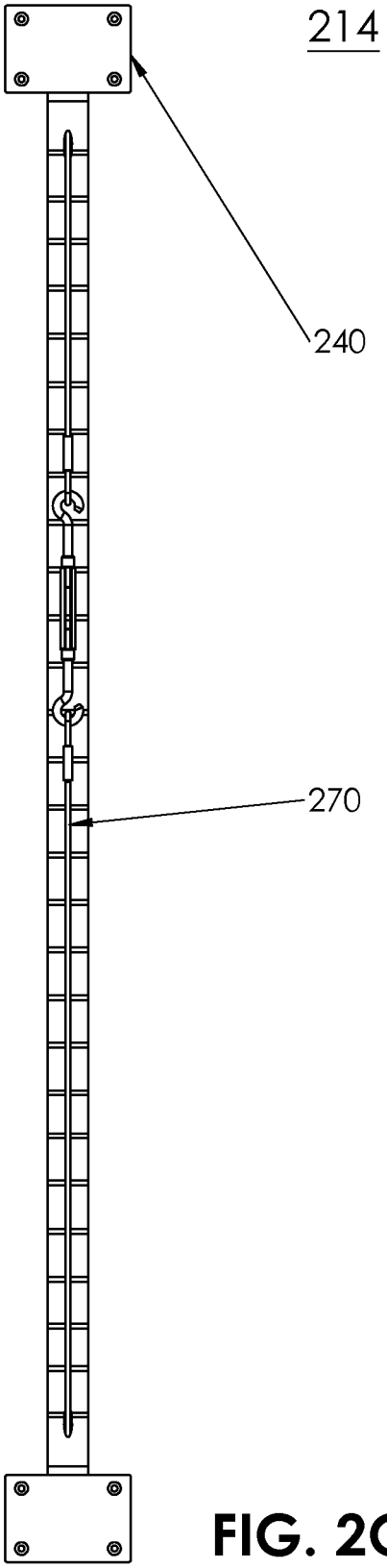
Figure 2H:
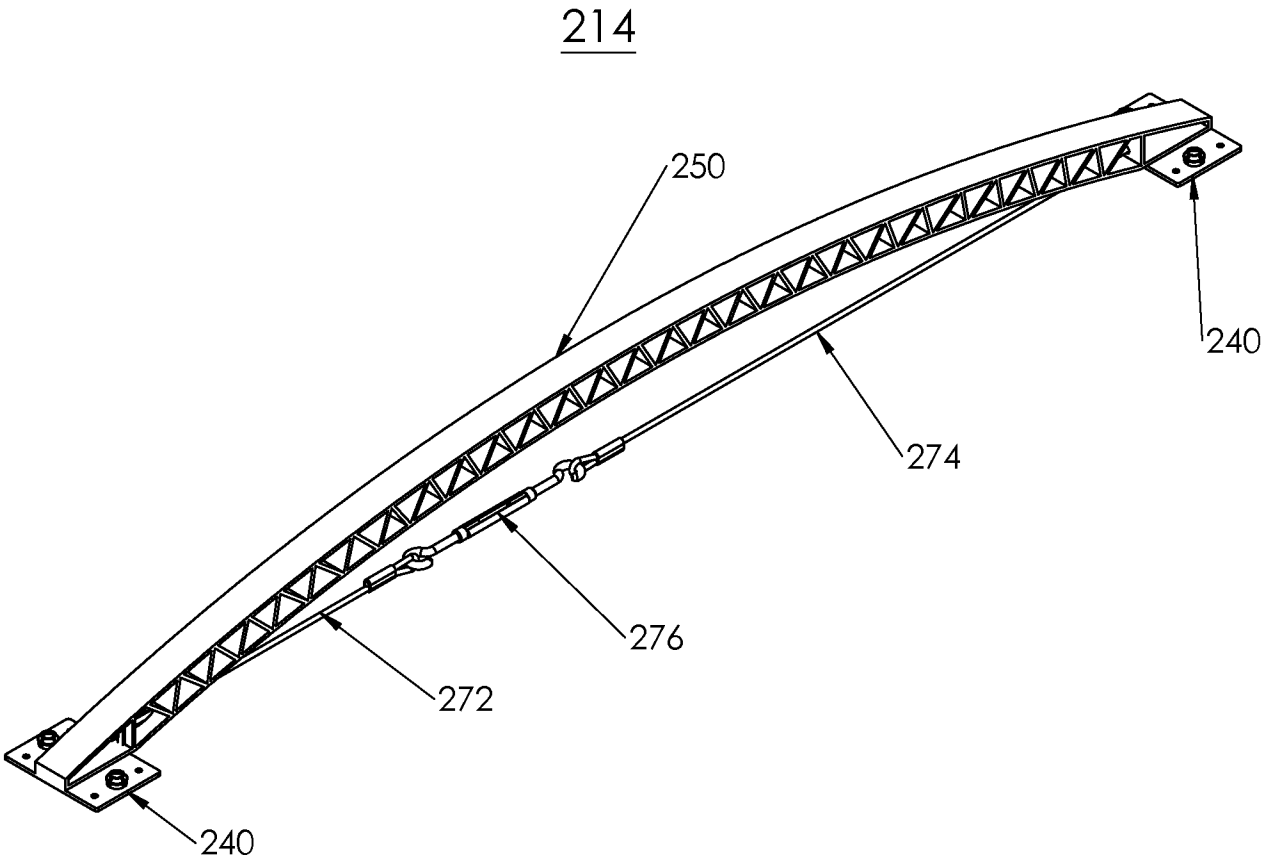

FIGS. 2G and 2H schematically illustrate a cable with a turnbuckle in accordance with yet another embodiment of the invention. FIGS. 2G and 2H are bottom and side views of a beam 214 with a cable 270. Beam 214 includes support elements 240 and arched element 250, similar to the beams described above.

Cable 270 is made of two cables 272 and 274 which are each connected to another end of arched element 250 and are interconnected by a turnbuckle 276. Cables 272 and 274 are connected to arched element 250 for example by loops and anchors or by stop sleeves. Cables 272 and 274 optionally do not contact a surface on which beam 214 is positioned. Beam 214 is optionally prestressed to the desired tensile strength after attaching cable 270 by turning turnbuckle 276 until the cable is stressed to the desired tensile strength.

FIGS. 2C-2H are exemplary only, the cables and methods of stressing can be replaced with any other methods known in the art. FIGS. 2C-2H are each shown with one cable. However, more cables can be used in accordance with exemplary embodiments of the invention. Optionally, additional cables can be provided parallel to the cable shown.

Optionally, a beam can have cables with different attachment and stretching means as for example illustrated in FIGS. 2C-2H. Alternatively, some beams may be used without cables.

Optionally, the cables may be replaced when worn out or torn.

In some embodiments, the cables are made of steel. Alternatively, the cables are made of suitable polymer materials. Optionally, when the straps of the load are made of steel, the straps of the load can serve as a tension element and provide the necessary tensile strength instead or in addition to the cables described above. Optionally, the straps are tightened by strapping tools known in the art.

In some embodiments, the pallet and/or beams are made of a material having flexural modulus of between 1200-1800 MPa and impact strength of between 4-5 $KJ/m^2$. Optionally, the pallet and/or beams are made from polypropylene and/or polyethylene.

Alternatively, the beams can be made of a stronger material than the pallet. For example, the pallet can be made of recycled materials and the beams can be made of polypropylene and/or polyethylene. Optionally, the beams are made of even stronger materials, for example a material having a flexural modulus of about 2,500 MPa and an impact strength of between about 20-35 $KJ/m^2$ such as Polycarbonate. In these embodiments, the beams are adapted to carry at least between about 200-300 kg or 250-300 kg of load for each kg of raw material of the beams. For example, three beams of 1 kg each can carry at least about 1000 kg of load.

FIGS. 3A-3D illustrate upper, bottom and side views of a pallet 300 and beams 310 according to an exemplary embodiment of the invention, where the pallet and beams are made of an integral piece. Optionally, the pallet and beams are made by injection molding.

Beams 310 include two support elements 340 and an arched shape element 350 between the support elements. Element 350 has an upper surface 352 which conforms to the shape of the pallet, in this case a flat surface. Element 350 also has a bottom surface 354 which has an arched shape. Element 350 may be reinforced by at least one tension element, optionally cable(s) 358, similar to the cables described above. It is noted that prestressing the beam may cause bending of pallet 300.

Cables 358 may be removed when stacking the pallet or for replacing a worn out or torn cable.

Figure 3A:
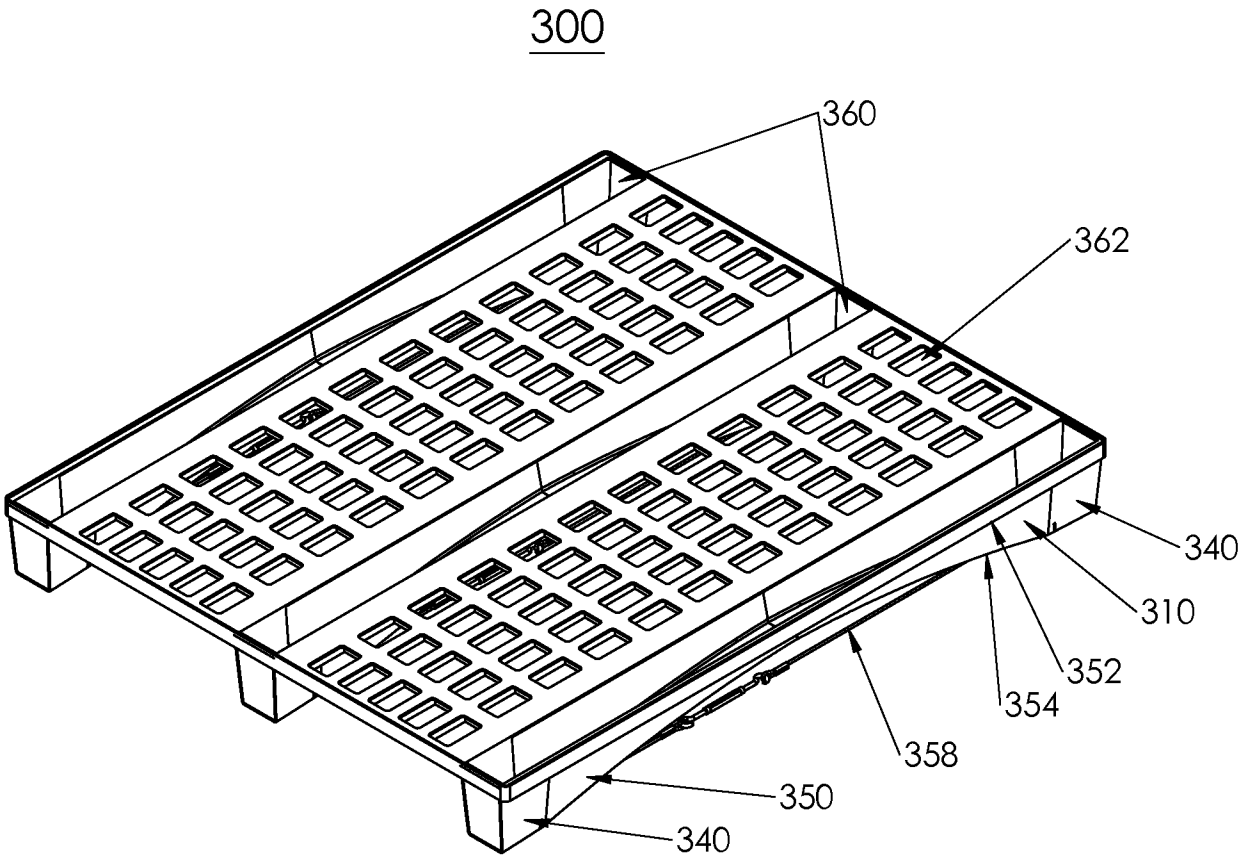
FIGS. 3A-3D are schematic illustrations of upper, bottom and side views of an integral pallet and beams according to some embodiments of the invention.
Figure 3B:
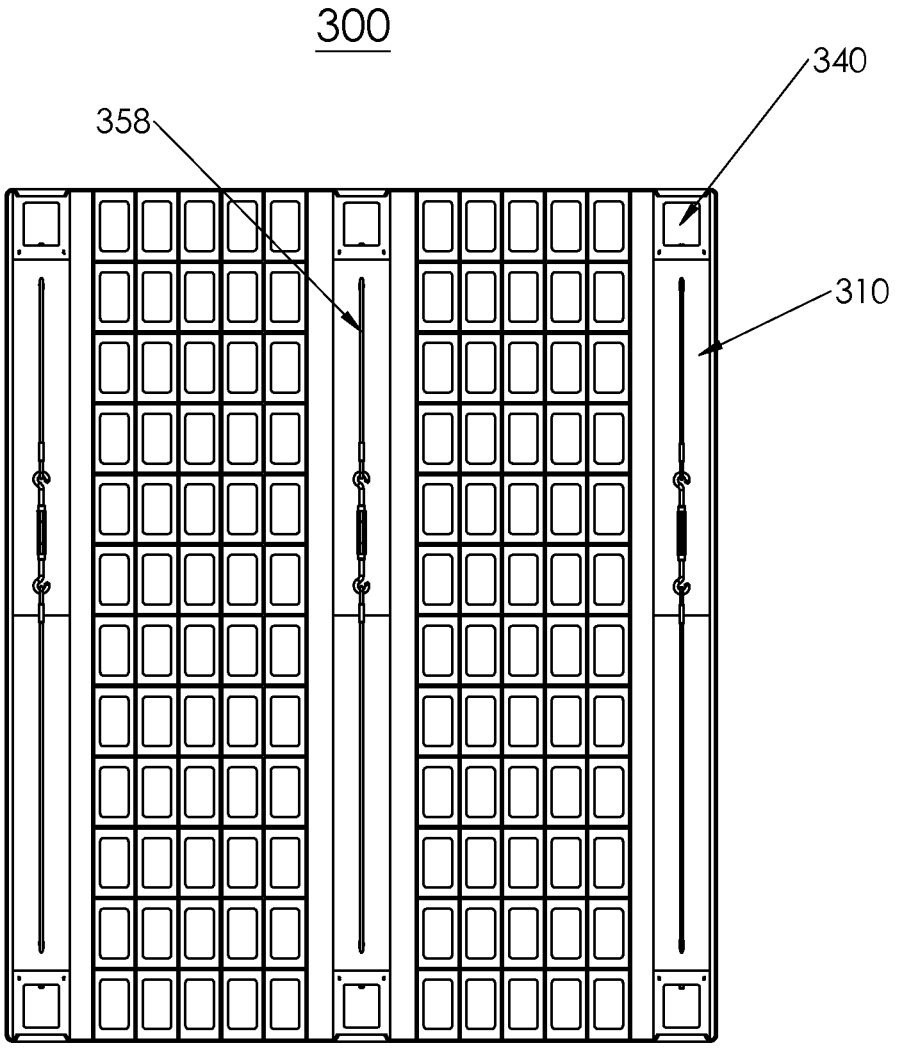
Figure 3C:
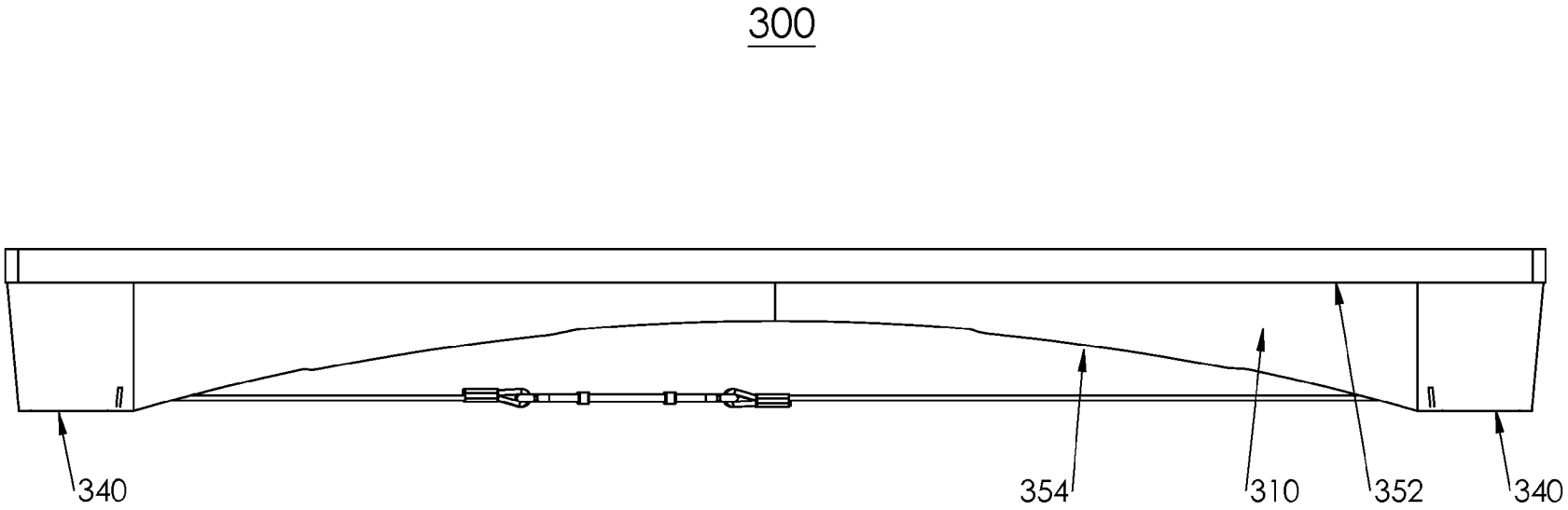
Figure 3D:
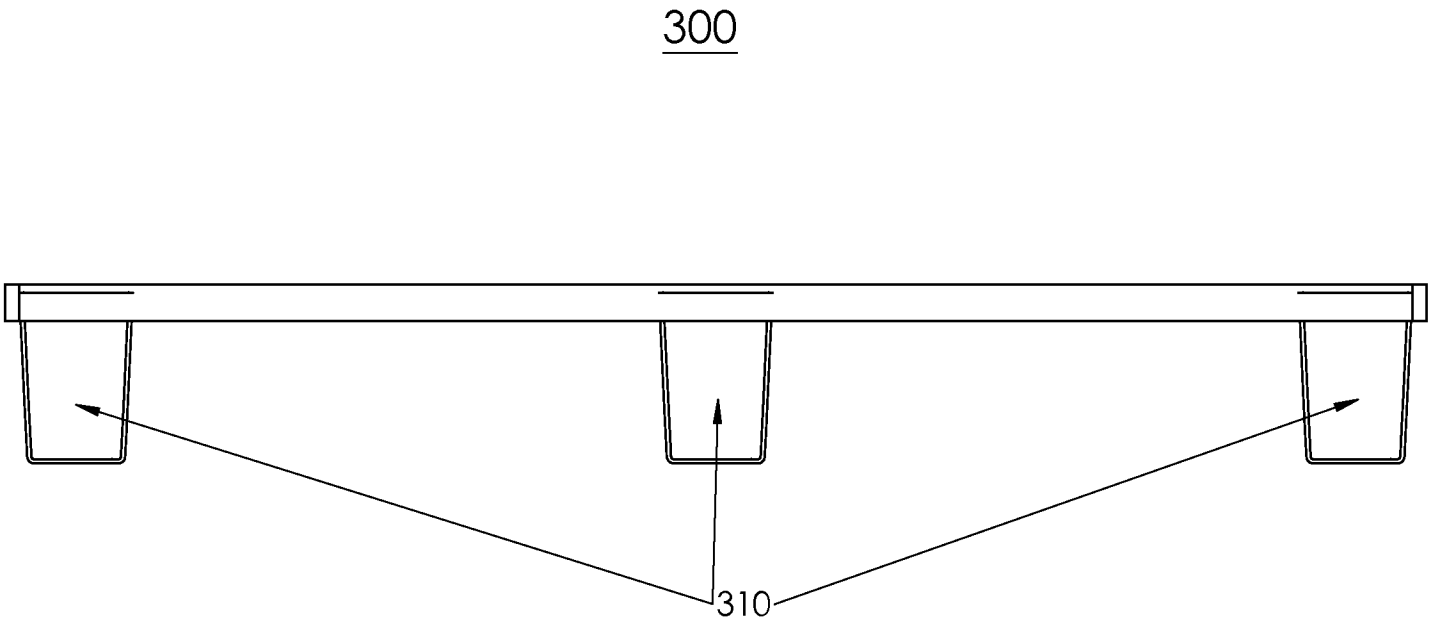
Figure 3E:
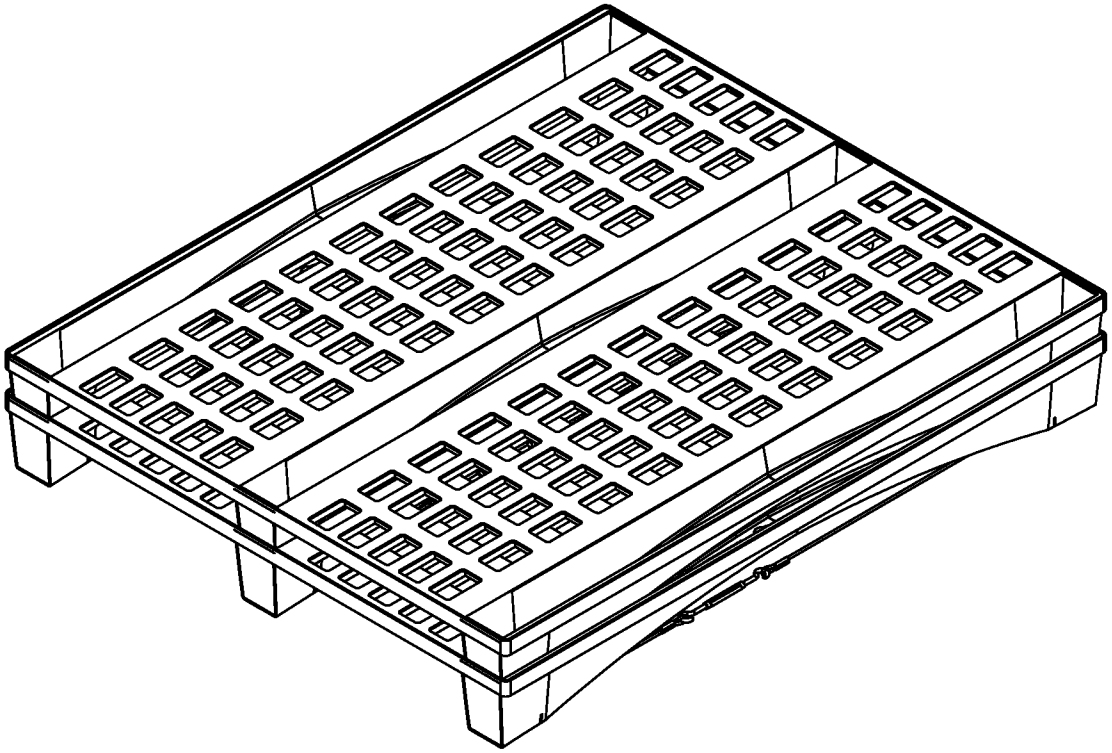
FIGS. 3E and 3F are schematic illustrations of stacking of the pallet FIGS. 3A-3D according to some embodiments of the invention.
Figure 3F:
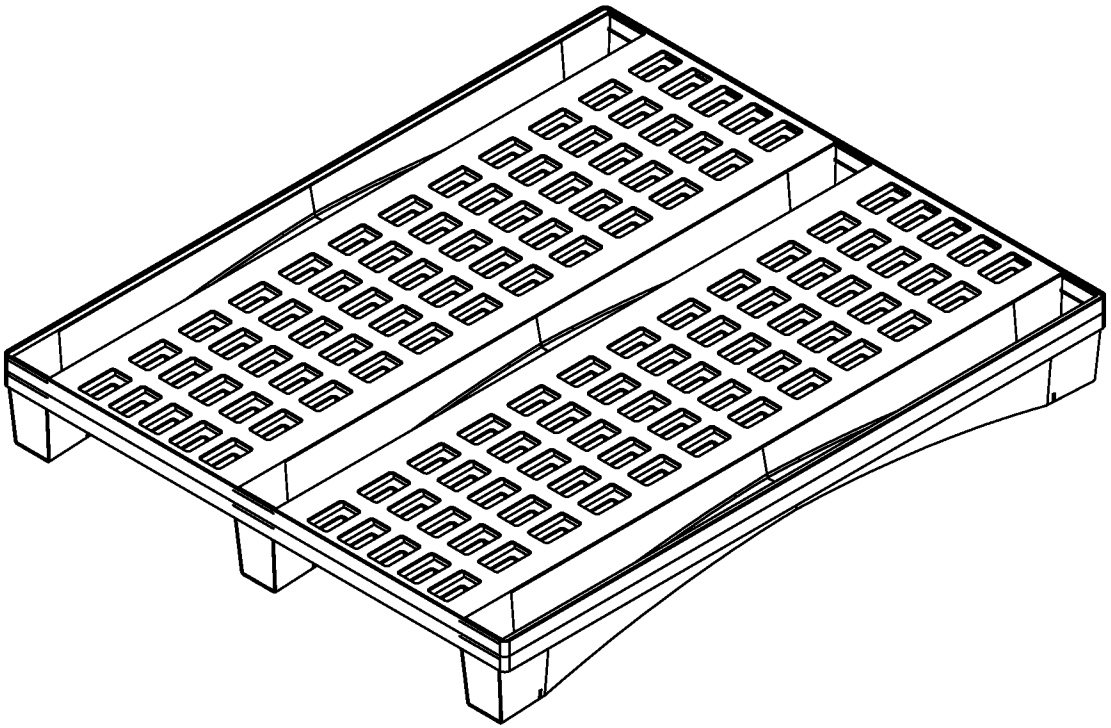

The upper surface of pallet 300 may have indents 360 for receiving beams of another pallet when stacked. FIG. 3E illustrates two stacked pallets 300 when the cables of the beams are left on the pallets. FIG. 3F illustrates two stacked pallets 300 where the cables have been removed before stacking (or before adding the cables).

In some embodiments, stacking pallets with indents may save between about 10%-95% of stacking space as opposed to stacking the same pallets without indents. For example, stacking pallets with indents as described can save about 40-60%, for example about 50%, of stacking space, as shown in FIG. 3E. When the cables are removed before stacking, about 60-90%, for example between 70-80%, stacking space can be saved as opposed to stacking the same pallets without indents as described. The described stacking space may be relevant to all embodiments described herein.

In some embodiments, the upper surface of the pallet may have additional openings or windows 362 in order to save material and weight of the pallet.

Figure 4A:
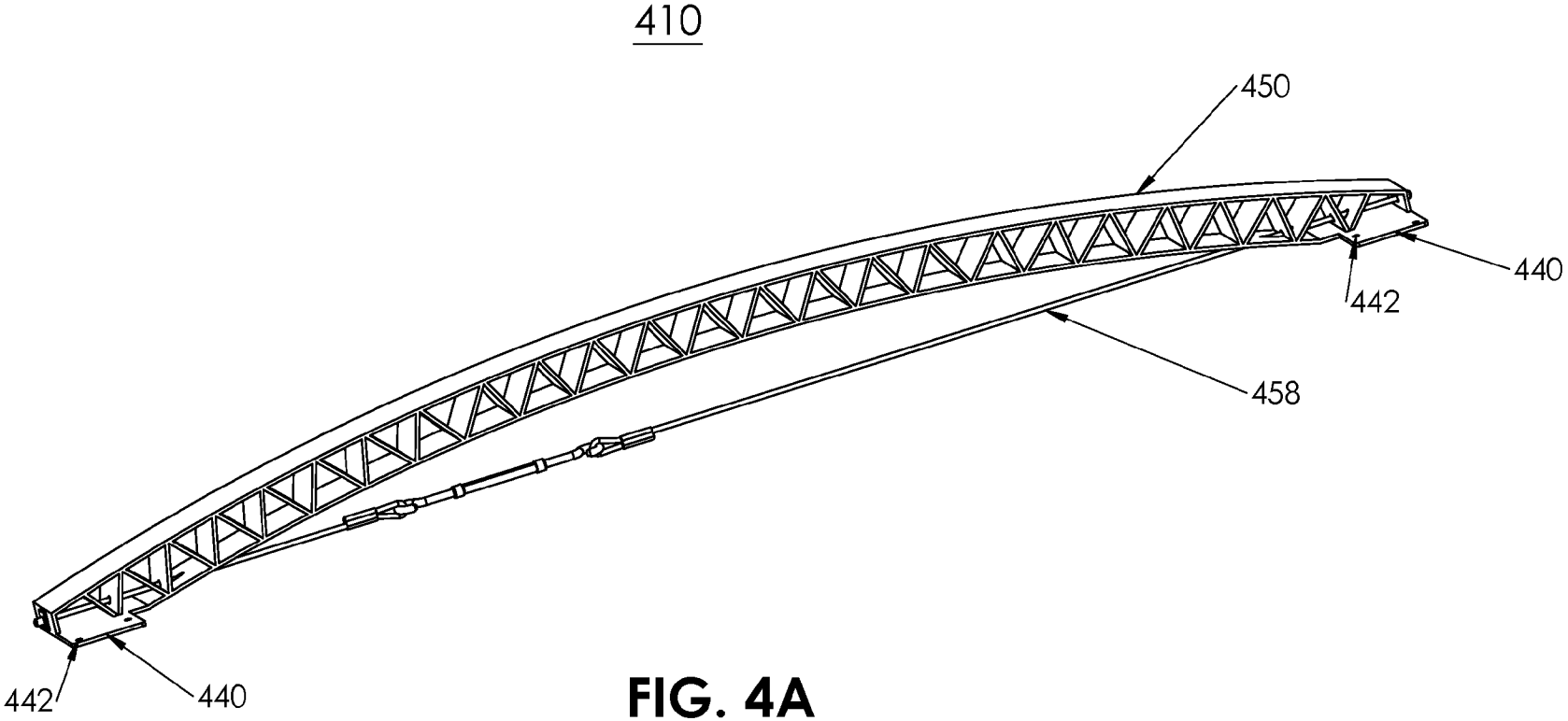
FIG. 4A is a schematic illustration of a retrofit beam according to some embodiments of the invention.

FIG. 4A is a schematic illustration of a retrofit beam 410 according to some embodiments of the invention.

Retrofit beam 410 is adapted to be attached to a plurality of pallet designs, thereby reinforcing the pallet and enabling it to carry more load and/or to be racked.

Optionally, for example in order for the beams to support the pallet during racking, a side of the pallet should have the same length as the beam. Optionally, the length of the beam is between about 90-140 cm, for example about 100 cm, 110 cm, 113 cm or 120 cm.

Beam 410 includes a curved force carrying element 450 and cable(s) 458 similar to any of the curved force carrying elements and cable(s) detailed above. Although cable 458 is shown with a turnbuckle, any other cable and tightening means can be used in accordance with exemplary embodiments of the invention, for example the cables and tightening means described with respect to FIGS. 2C-2H above.

In some embodiments, the force carrying element is not curved as described above but acts like an arch in that the forces from the load are resolved into compressive stresses and push the arch outwards. For example, the force carrying element of beam 410 can have a shape of a triangular truss which may be positioned between two substantially flat supports.

Beam 410 optionally further comprises two support elements 440 at its ends. Support elements 440 are adapted to be attached to different types of pallets. Support elements 440 extend over the width of arched element 450 and may include one or more holes 442 through which screws, rivets, spikes or the like may be inserted for securing the beam to the pallet.

Figure 4B:
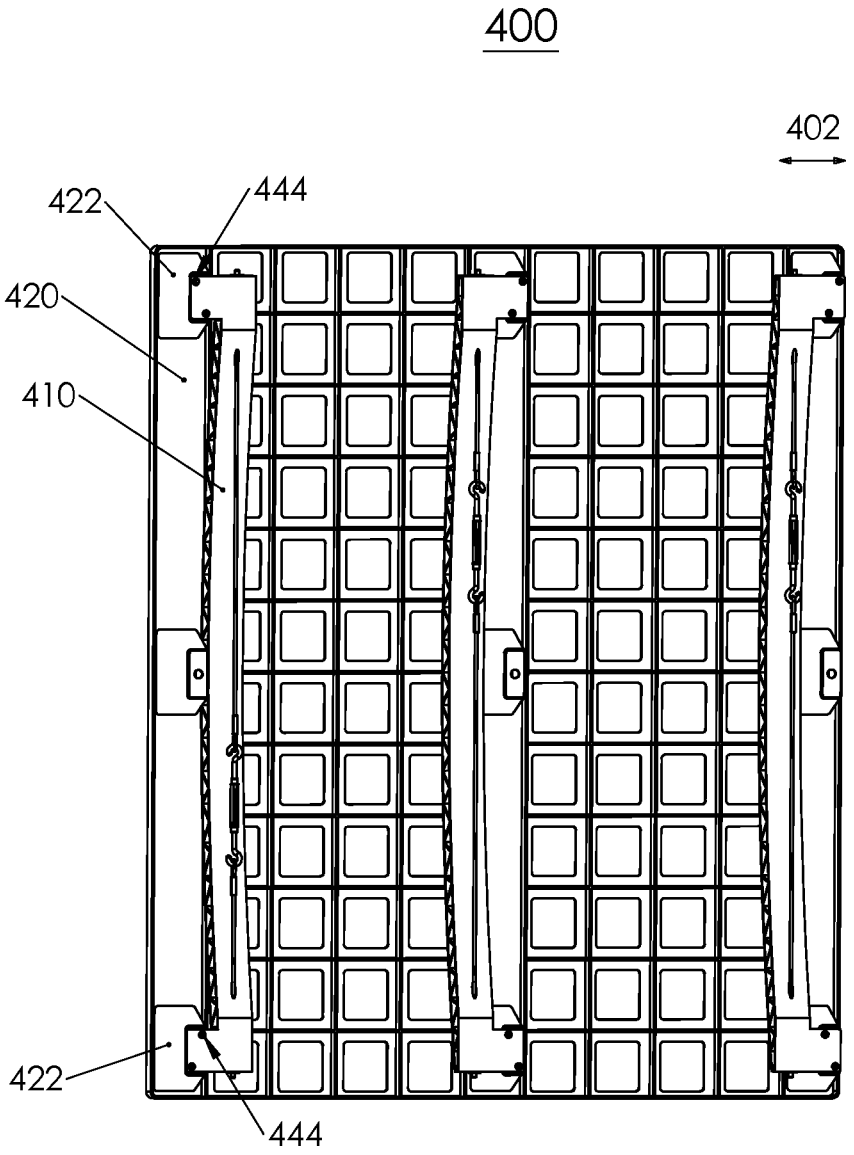
FIGS. 4B-4D are schematic illustrations of bottom and side views of a pallet with the retrofit beam of FIG. 4A according to some embodiments of the invention.
Figure 4C:
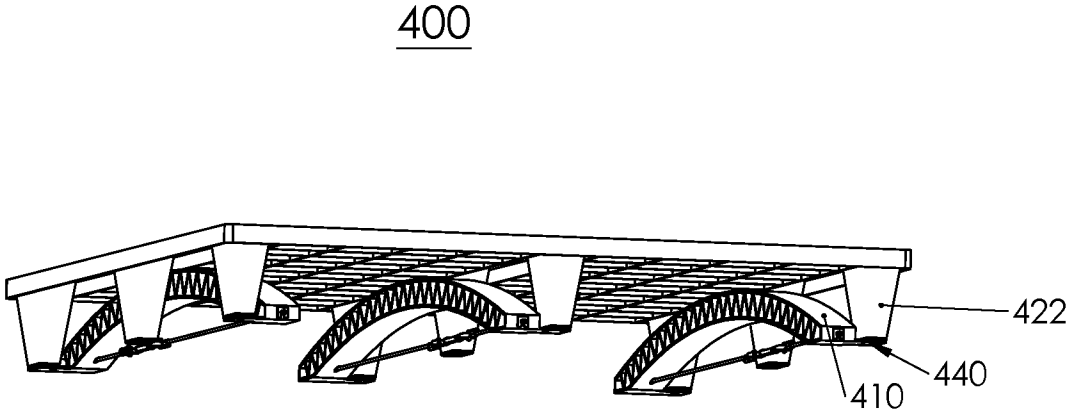
Figure 4D:
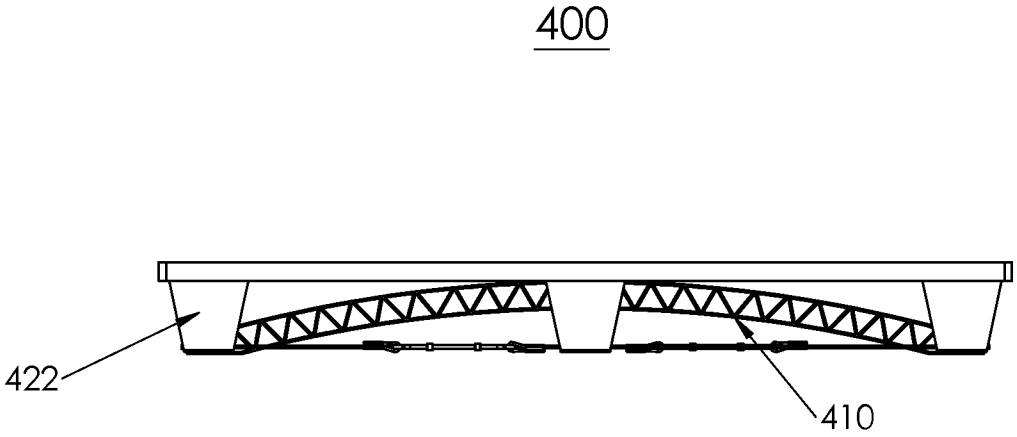

The attachment of beam 410 to a pallet according to an exemplary embodiment of the invention will be described with respect to FIGS. 4B-4D which schematically illustrate bottom and side views of an ordinary pallet 400 with retrofit beams 410.

Although three beams are illustrated, it is noted that any number of beams may be attached according to different embodiments of the invention, for example, 1, 2, 4 or 6 beams may be attached. In addition, the beams may be attached in any direction and position as referred to above with respect to beams 110 in FIGS. 1A-1D and beams 610 in FIGS. 6A-6C.

A bottom surface 420 of pallet 400 (shown in FIG. 4B) optionally includes a number of feet 422 for supporting the pallet. Feet 422 are generally arranged at a 3×3 matrix at the bottom surface of the pallet, however, pallets with less or more feet can also be used in accordance with exemplary embodiments of the invention. Optionally, the extending portions of supporting elements 440 are attached to two opposite outer feet 422. The beams are thereby attached along the length or width of the pallet.

The position and direction of the beams may be chosen according to the intended use of the pallet, as detailed with respect to FIGS. 1A-1G above, for example, in some embodiments, attaching three equally distanced beams to feet 422 enables the beam to support the pallet at the edges thereof and at the center, thereby reinforcing the pallet when racked. For example, in some embodiments, a space is left between the beams enabling a forklift to lift the bottom surface of the pallet.

Screws or rivets 444 are shown through holes 442 (FIG. 4A) attaching the supporting element to the foot of the pallet. It is noted that other means of attachment may be provided in accordance with exemplary embodiments of the invention, such as for example welding or glue.

In some embodiments, the extending portion of the support elements enables the arched element to be positioned aside the length between the two feet to which the support elements are attached. In these embodiments, the arched element does not impede with a third foot provided between two outer feet 422. Optionally, the arched element is also fixed to the pallet, for example by a screw, in order to prevent side movement of the arched element in the directions 402 (FIG. 4B).

In some embodiments, the retrofit beams are removably attached to the pallet and can be removed after use without causing damage to the beams and pallet. The beams can for example be removed for stacking thereby enabling the feet of a pallet to be inserted into indents of another pallet. The beams may also be removed when using the pallets with a relatively light load, when no reinforcement of the pallet is required. For example, when the beams are attached by screws, the screws can be unscrewed for removing the beams. The beams can then be reattached for reuse of the reinforced pallet. Alternatively, the beams are permanently attached and cannot be removed without causing damage to the pallet and/or beams.

FIGS. 5A-5D are upper, side and bottom views of a standalone beam 510. In an exemplary embodiment of the invention, beam 510 can be directly attached to a load, without requiring a pallet for shipping and transferring the load. In exemplary embodiments of the invention, the load can be shipped, lifted by a forklift and/or racked without providing a support to the entire bottom surface of the load. Optionally, only between about 20%-60% of the bottom surface of the load is supported by the beams. For example, less than about 25%, 30%, 40% or 50% of the bottom surface of the load may be supported by the beams. The beam is constructed, as detailed below, so as to form a structural synergy between the beam, the load and optionally a strap of the load.

Beam 510 includes two support elements 540 at its ends and a force carrying element between the support elements, herein referred to as arched element 550. Force carrying element 550 may have a similar structure as any of the curved force carrying elements or other force carrying elements detailed above.

Figure 5A:
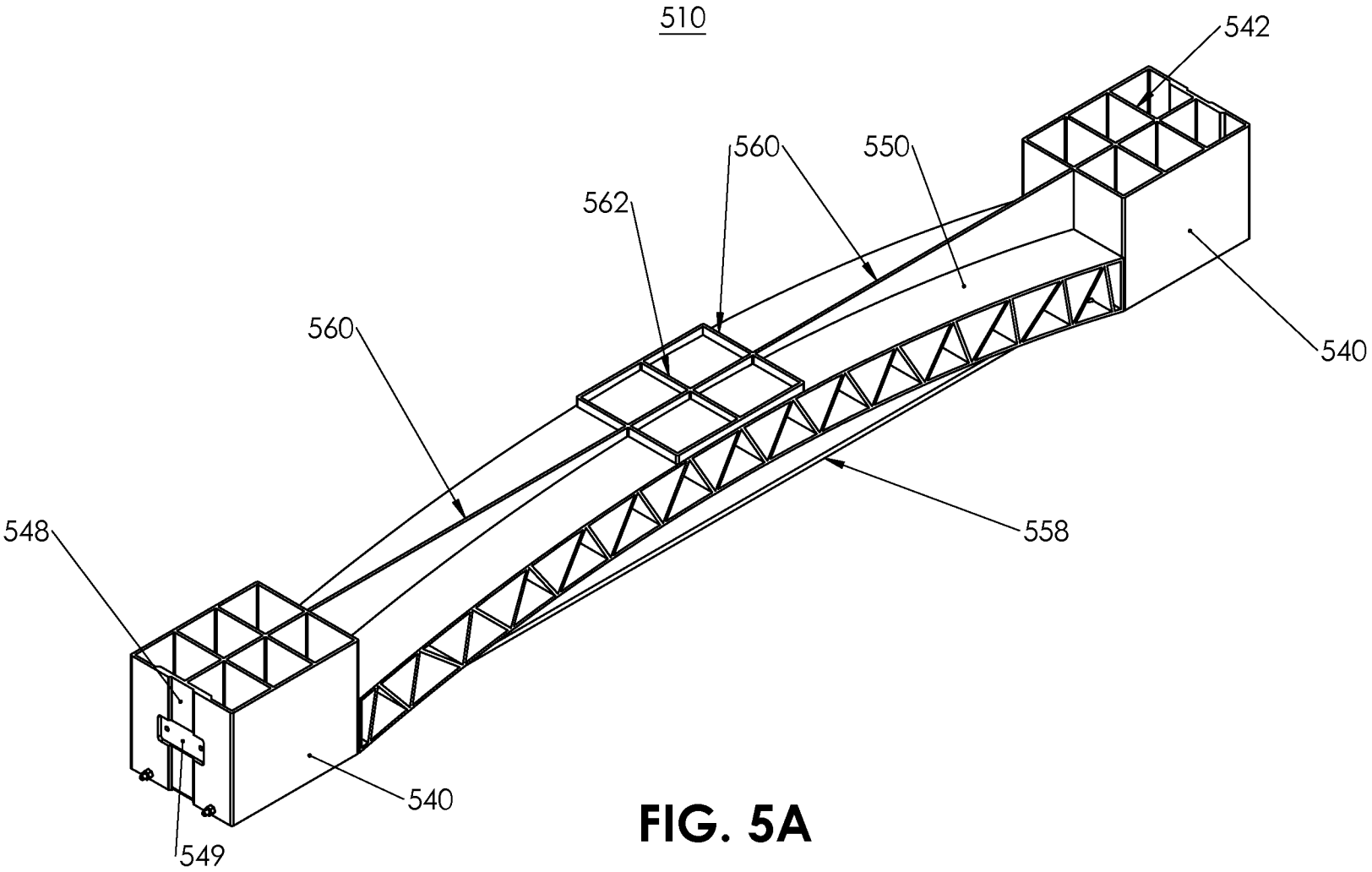
FIGS. 5A-5D are schematic illustrations of upper, side and bottom views of a standalone beam according to some embodiments of the invention.
Figure 5B:
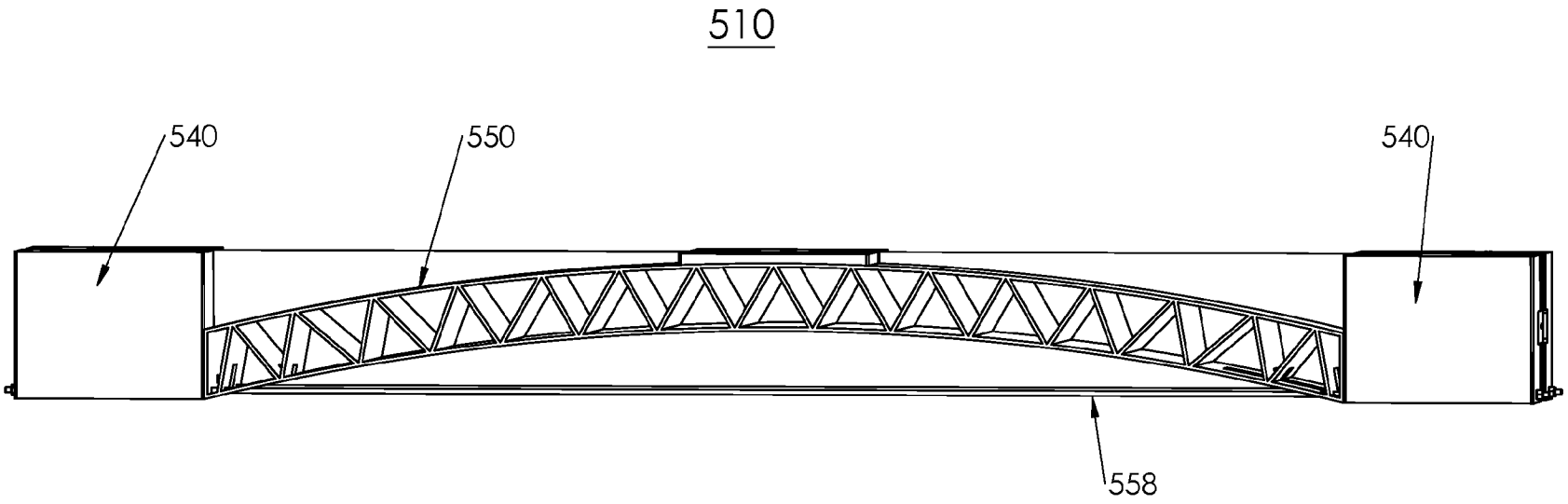
Figure 5C:
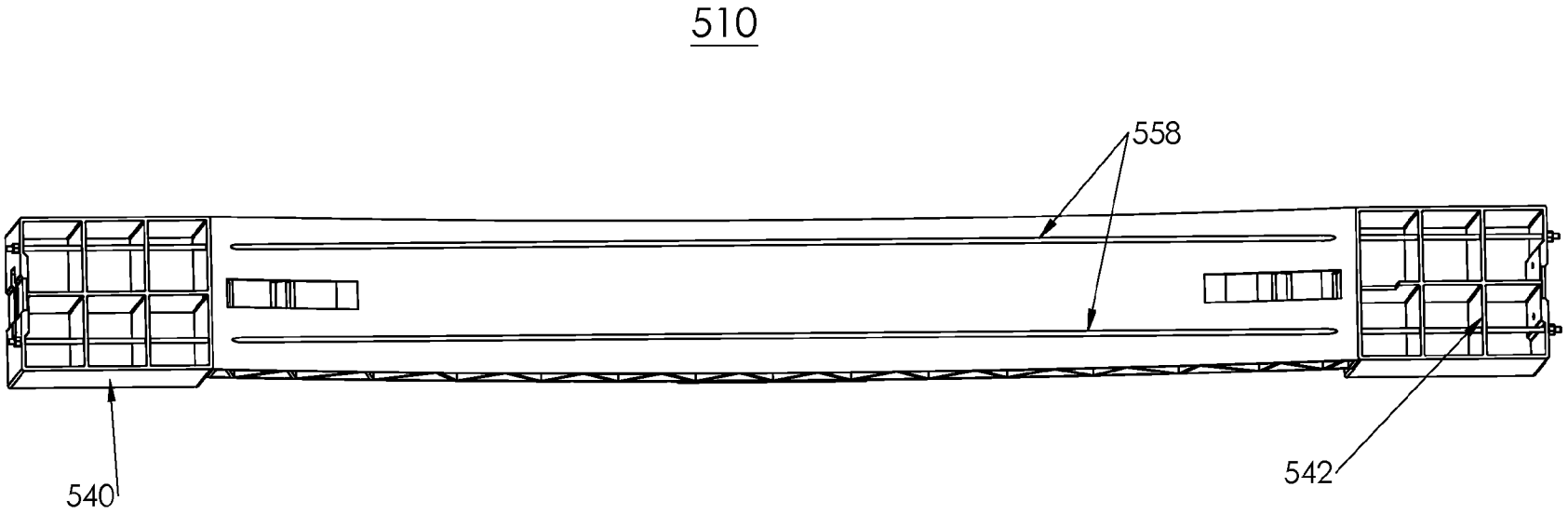
Figure 5D:
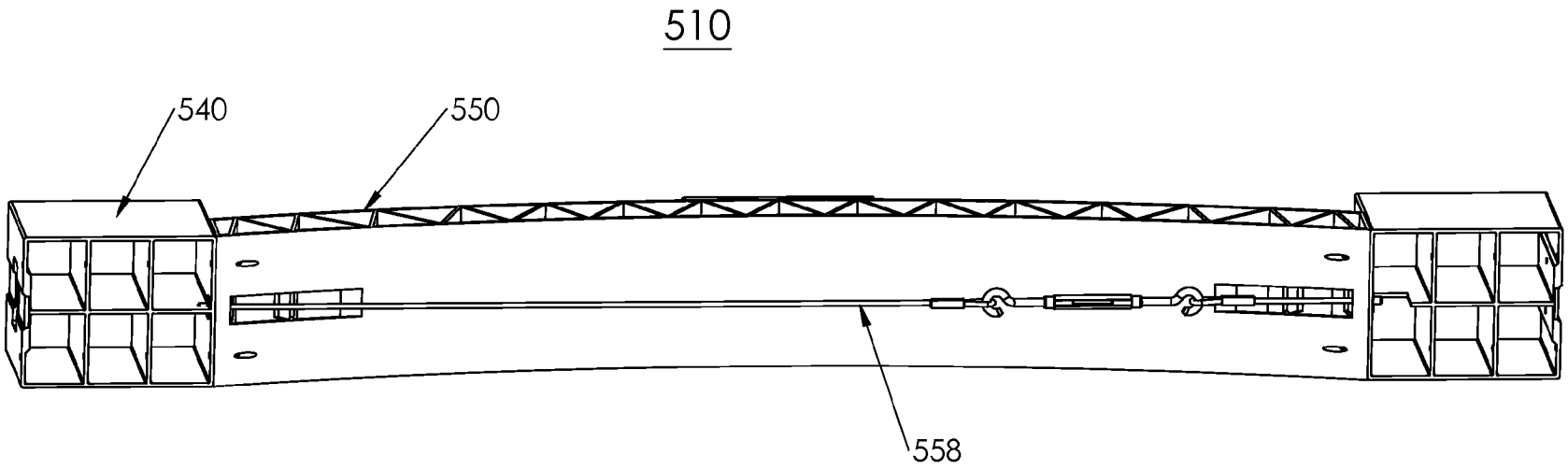
Figure 5E:
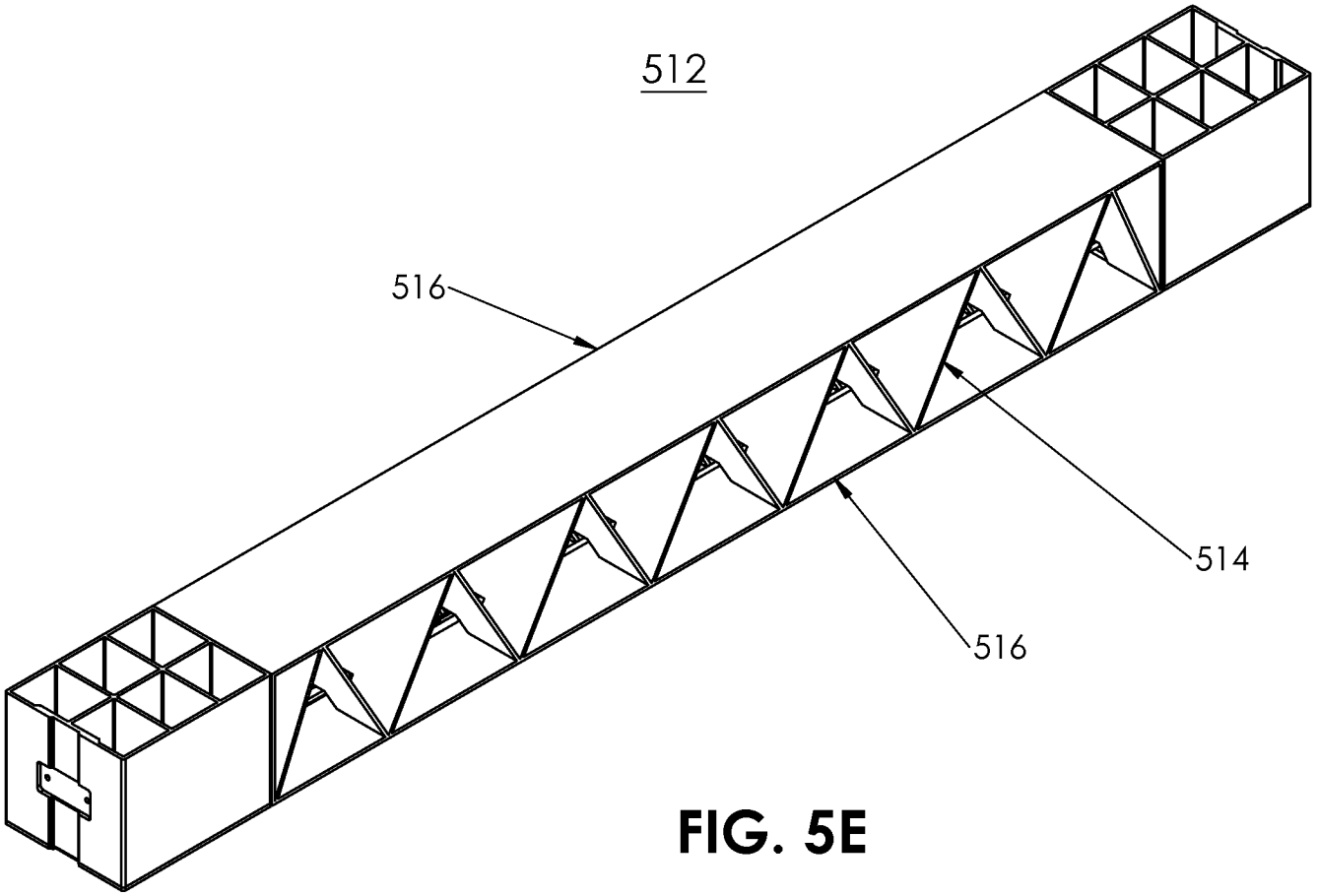
FIG. 5E is a schematic illustration of a side view of a standalone beam in accordance with another embodiment of the invention.

For example, FIG. 5E is a schematic illustration of a standalone beam 510 where the force carrying element is not curved but has the shape of a triangular truss 514 which is positioned between two substantially flat surfaces 516. It is noted that the arched elements of the beams described in any of FIGS. 1-4 above may also have similar shapes.

In some embodiments, arched element 550 compensates for the lack of a pallet and may be wider than for example arched element 150 referred to in FIGS. 1A-1G.

Optionally, the width of standalone beam 510 is between about 8-16 cm, for example between 10-14 cm.

Support elements 540 are generally at least at the height of arched element 550 and are adapted to extend along the entire height of the beam. Support elements are adapted to support the load from its bottom surface, similar to feet of a pallet.

Optionally, only the support elements contact a surface on which the load is positioned. The support elements may also provide a connection between the load and the arched element. Support elements 540 are optionally hollow, in order to save material and/or weight of the beam, and may include a number of ribs 542 in it.

Optionally, an additional support element (not shown) is provided at the extreme point of arched element. The additional support element may support the load when placed on a ground or the like, but will not provide support during racking.

Beam 510 further optionally includes at least one rib 560 for supporting the bottom surface of the load. A plurality of ribs 560 are optionally positioned on top of arched element 550 and may form a connection between support elements 540. Each rib 560 may be between about 3-5 mm thick. Ribs 560 may form a flat surface 562 for supporting the load. Flat surface 562 is optionally at the same width as arched element, although in some embodiments, for example when the bottom surface of the load is not substantially flat, flat surface 562 may be wider than arched element 550. Flat surface 562 may be provided, as shown, at the center of arched element only, and may be between about 8-12 cm long, for example about 10 cm long.

It is noted that ribs 560 and flat surface 562 may also be provided on any of the embodiments described above, for example on the beams shown in FIGS. 2 and 4.

In other embodiments, the upper surface of beam 510 may be substantially flat (for example as in FIG. 5E). These embodiments may for example be used with loads which do not have a flat bottom surface and require more support, such as big-bags.

Arched element 550 may be prestressed by providing one or more stressed cables 558 along the length of arched element 550. Alternatively, the arched element is first prestressed (for example as detailed with respect to FIGS. 2C and 2D) and the stress of the beam is maintained by one or more cables 158. Optionally, two three, four or more cables are provided. For example, FIG. 5C illustrates a bottom surface of a beam with two cables and FIG. 5D illustrates a bottom surface of a beam having one cable. The cables are tightened and resist flattening of the arched element when load is placed on the beam. The cables may be attached and tightened according to any means shown in FIGS. 2C-2H or according to other methods known in the art.

In some embodiments, the arched elements are prestressed by between 50-200 kg tensile strength by stressing the cables to the desired tensile strength, for example the cables are stressed to about 100 kg, 150 kg or 200 kg tensile strength.

Figure 5F:
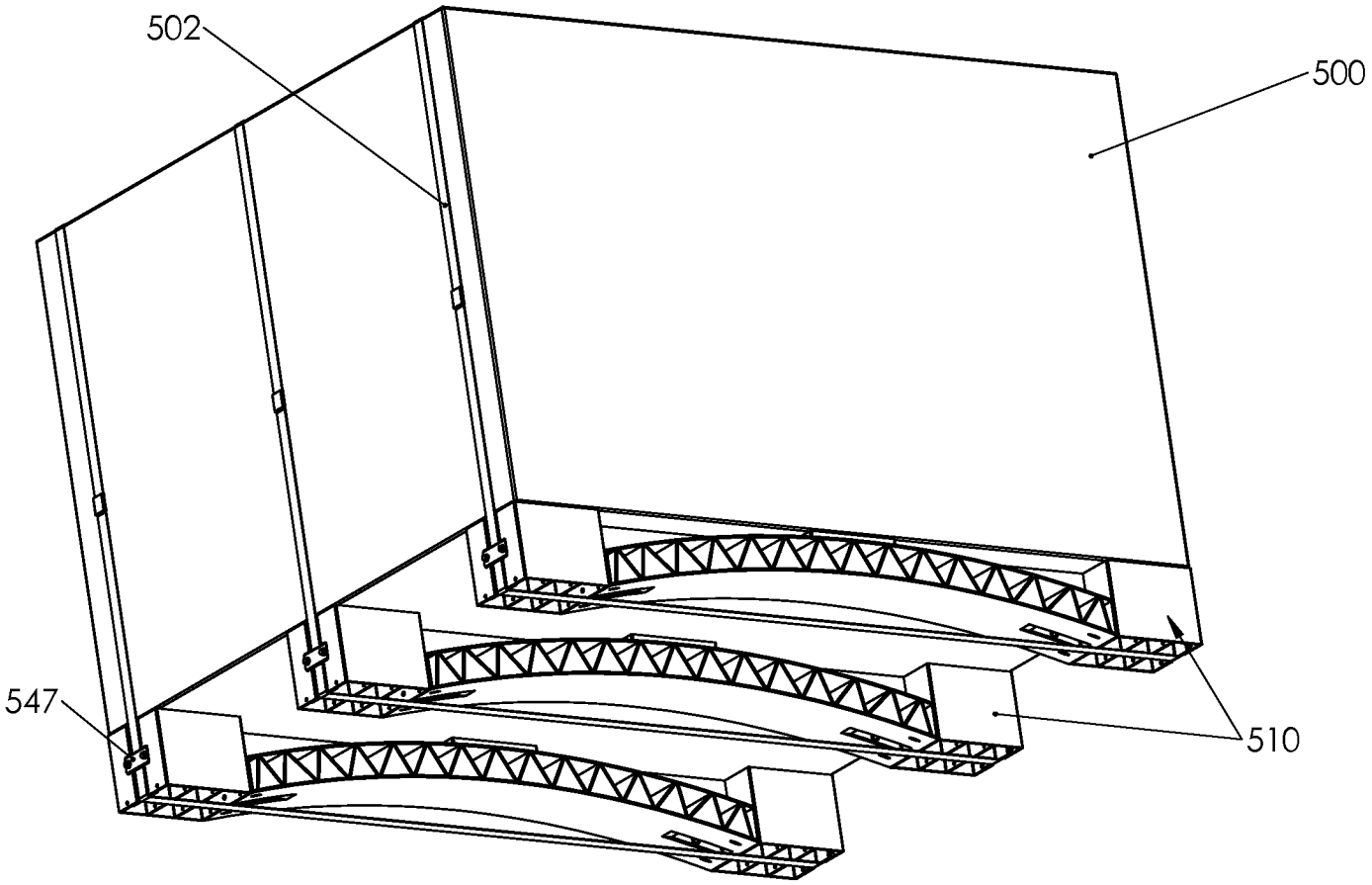
FIGS. 5F-5H are schematic illustrations of a load with standalone beams of FIGS. 5A-5D according to some embodiments of the invention.

FIG. 5F schematically illustrates a load 500 whereto beams 510 are attached by means of straps 502. Such straps usually attach the load to a pallet or the like. The straps are optionally attached to the support elements, along the length of the beam and do not interfere with a forklift that is passed between the beams. Optionally, the straps are fastened to the support elements at the outer edges of the support elements.

Load 500 is shown in the form of a box but can have other shapes according to embodiments of the invention, for example bundles or big-bags.

In some embodiments, for example when the straps are made of steel, the straps can also be used in order to prestress the beam or in order to maintain a stress of a beam.

Figure 5G:
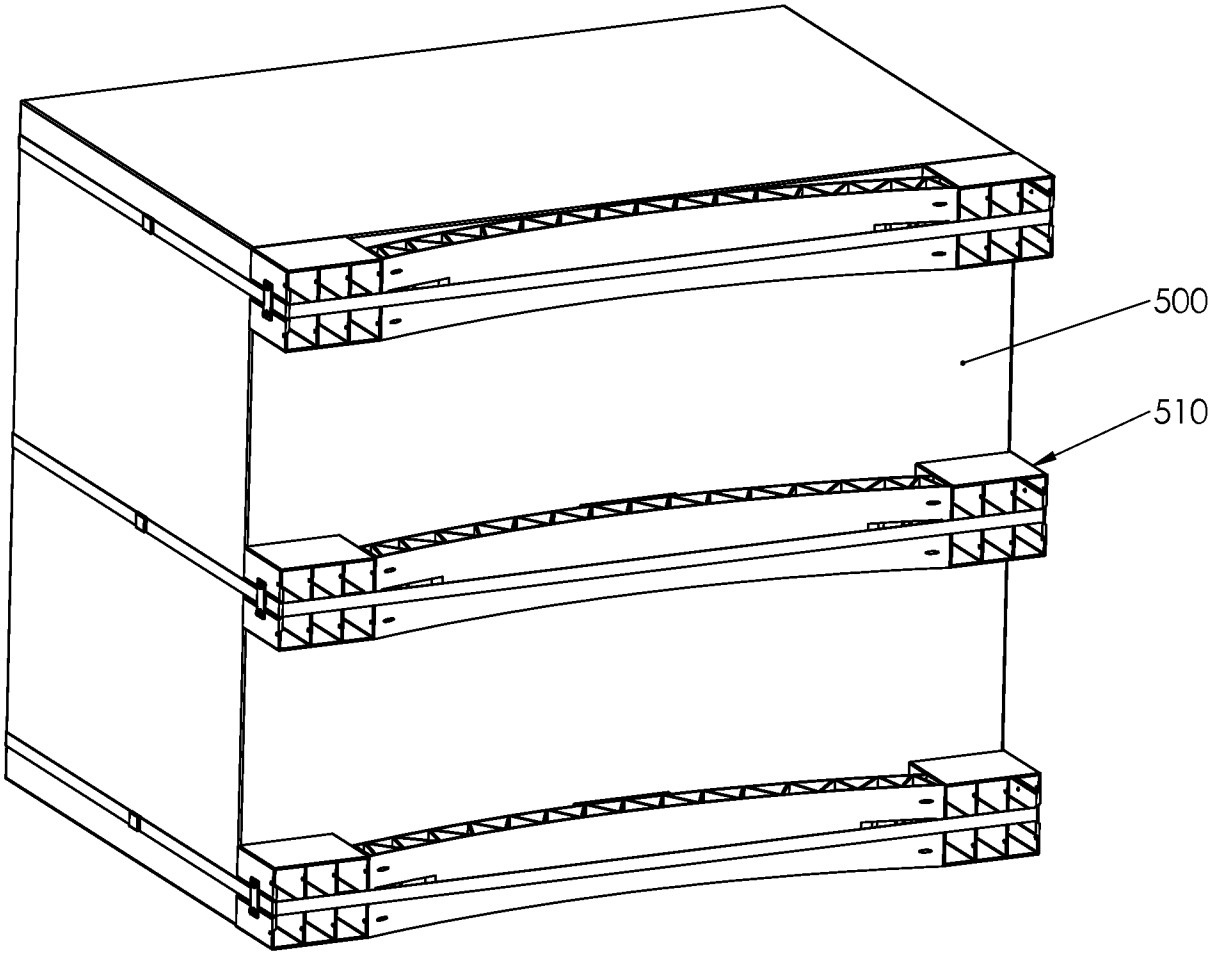
Figure 5H:
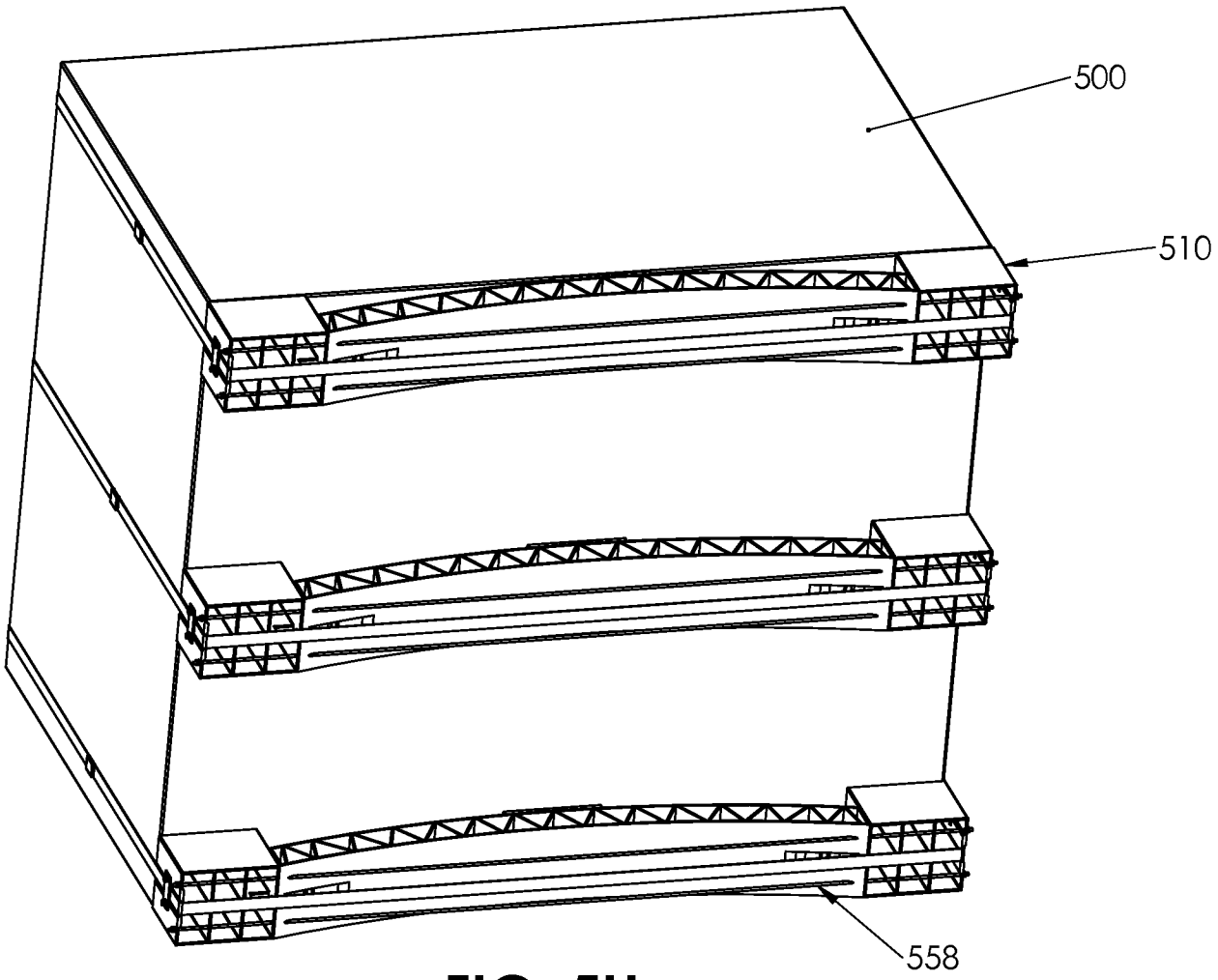
Figure 5I:
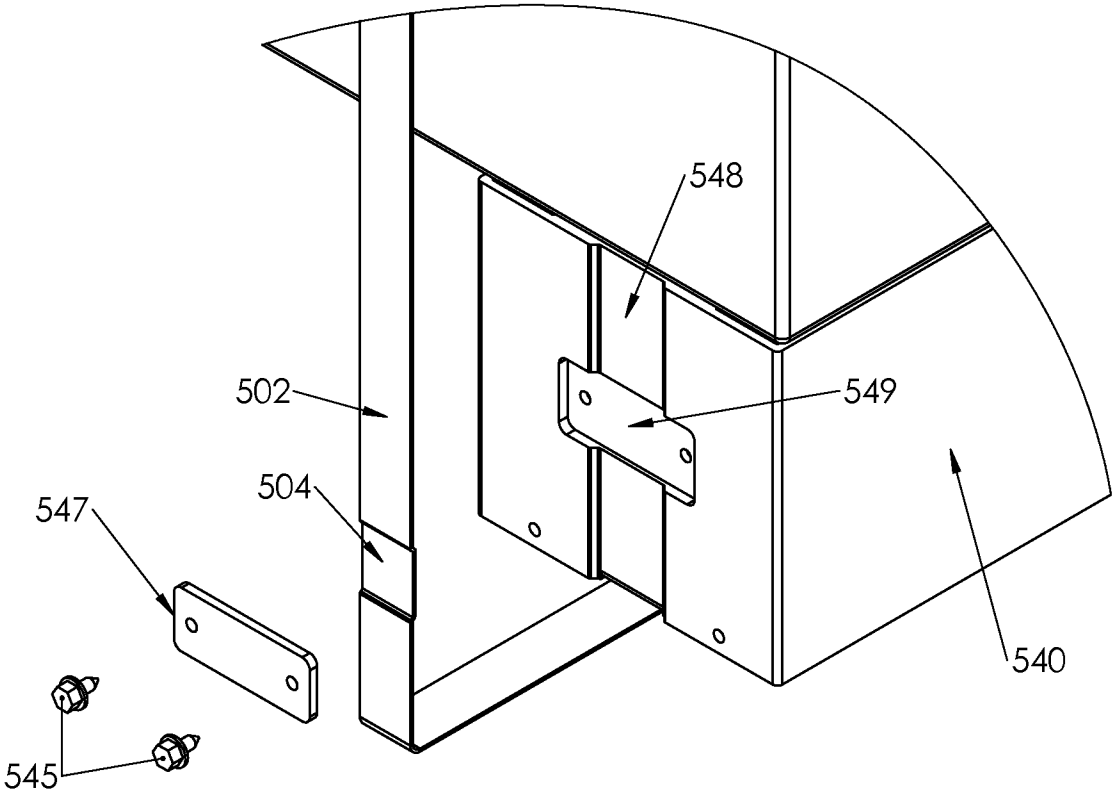
FIG. 5I is an exploded view of a support element of the beams shown in FIGS. 5A-5D and a tensioning element.

FIG. 5I is an exploded view of support element 540 and a tension element 502, showing the attachment of a tension element to a support element in accordance with some embodiments of the invention. In some embodiments, tension element 502 is a strap of the load.

Support element 540 may comprise an elongated indent 548 at its sides for holding the strap of the load and an additional recess 549 for receiving a clamp 547 to fasten the strap by screws 545 or the like. The straps are tightened by a strapping tool known in the art, and then fastened with clamp 547 or the like. Clamp 547 locks strap 502 onto recess 549 thereby creating a dent 504 in the strap. Dent 504 provides a structural synergy between beams 510 and straps 502.

In some embodiments, the following method is used for attaching a tension element, such as a strap, to a beam. It is noted that the method below can be applied to any of the embodiments of the invention described herein. For example, the beam may be a standalone beam as in FIGS. 5A-5I or attached to a pallet as in FIGS. 1A-1G, 4A-4D and 6A-6C.

A strap is positioned along the length of the beam. In some embodiments, the strap is first attached to the beam, thereby prestressing the beam before load is placed on the pallet. The strap is tightened by a strapping tool or other tightening means known in the art and is attached to the first support element by locking the strap with clamp 547 or a similar element onto recess 549, thereby creating dents in the strap.

In other embodiments, the load is first placed on the beams and the strap is then tightened and attached to the beams. In these embodiments, optionally other means for prestressing the beams are provided, for example by attaching one or more stressed cables, for example in accordance with any of the methods described with respect to FIGS. 2C-2H.

Alternatively, other means for maintaining a curvature of the arched element when positioned on a flat surface can be provided. For example, in some embodiments a third support element is provided at the center of the beam, optionally at the extreme point of the beam. The third support element assists in maintaining a curvature of the arched element when loaded beams are positioned on a flat surface, such as a ground. In some embodiments, the straps are then tightened and fastened to the support elements as detailed above and maintain a curvature of the arched element also when the beams are for example racked.

FIG. 5G is a bottom view of a load where the straps of the load are used instead of cables. FIG. 5H is a bottom view of a load where straps of the load are used in addition to cables 558.

Load 500 is shown attached to three beams 510. It is noted that the number of beams and their positions may be chosen according to the form of the load and its heaviness. For example, for a load having a weight of 1 ton, three beams of 3 kg raw material each or two beams of 3 kg raw material each can be used. If the load has a straight bottom surface, generally fewer beams will be required for supporting it.

The position of the beams may be chosen according to the use of the load, for example if it is intended to be lifted by a forklift the beams should be positioned such as to leave a space for the forklift. For example, the beams should be positioned substantially parallel to each other, leaving a space for a forklift to pass in between the beams and lift the bottom surface of the load that is not covered by a beam. If the load is intended to be racked, two beams are optionally positioned on parallel edges of the load and one or more additional beams may be provided in between the two beams.

In some embodiments, beams 510 are made of a material having a Flexural Modulus of between about 1,200-1,800 MPa and an Impact strength of between about 4-8 KJ/m$^2$ such as Polyethylene or Polypropylene. In these embodiments, the beams are adapted to carry between 100-150 kg or between 120-200 kg of load for each 1 kg of raw material of the beams. For example, a beam can carry about 140 kg, 150 kg or 160 kg of load, for each 1 kg of raw material. For example, three beams of 2 kg each, can carry about 800-1000 kg of load.

In other embodiments, beams 510 are made of a material having a Flexural Modulus of about 2,500 MPa and an Impact strength of between about 20-35 KJ/m$^2$ such as Polycarbonate. In these embodiments, the beams are adapted to carry between about 200-300 kg or 250-300 kg of load for each kg of raw material of the beams. For example, three beams of 1 kg each can carry about 1000 kg of load.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

What is claimed is:

1. A pallet for carrying load, comprising:

a load carrying part and at least one beam, the load carrying part comprising:

an upper surface configured to carry a load; and a bottom surface; and the at least one beam, being distinct from said load carrying part, and extending laterally below the bottom surface of said load carrying part, the beam consisting of a laterally extending force carrying element having a first lateral end and a second lateral end and a tension element, the tension element extending from said first lateral end to said second lateral end below said force carrying element, the tension element downwardly curving said force carrying element thereby to cause downward bowing of said force carrying element between said first lateral end and said second lateral end to maintain a tension of said force-carrying element.

2. A pallet according to claim 1, wherein said tension element is attached along the length of the force carrying element for maintaining said curvature of the force carrying element.

3. A pallet according to claim 2, wherein the force carrying element is prestressed before attaching the tension element to the force carrying element.

4. A pallet according to claim 3, wherein the tension element comprises one member of the group consisting of a cable attached to a hook and wherein the cable is stressed by rotating the hook, a cable and turnbuckle and wherein the cable is stressed by rotating the turnbuckle, and a cable that is shorter than the force-carrying element, and/or where the force-carrying element comprises one member of the group consisting of a flat element, an element in the form of a curved arch, and an element in the form of a cross-section of a dome.

5. A pallet according to claim 2, wherein the beam is prestressed by stressing the tension element.

6. A pallet according to claim 5, wherein the tension element is stressed to between 50-200 kg tensile strength.

7. A pallet according to claim 1, wherein at least three equally distanced beams are attached to the bottom surface of the pallet.

8. A pallet according to claim 1, wherein the pallet when racked is adapted to carry between 120-200 kg of load for each 1 kg of raw material of the pallet.

9. A pallet according to claim 1, wherein the beam is one member of the group consisting of being integrally formed with said pallet, and being removably attached to said pallet.

10. The pallet of claim 1, wherein said at least one beam comprises two beams diagonally attached.

11. A beam for directly attaching to a load, the beam comprising:

first and second support elements adapted to be attached to a strap of the load; and a force carrying element extending lengthwise between the first and second support elements respectively, the force carrying element having a first lateral end and a second lateral end, an upper side towards said load and a lower side away from said load, and a tension element, the tension element extending from said first lateral end to said second lateral end on said lower side to curve said force carrying element in a direction of said lower side, thereby to maintain a tension of said force-carrying element.

12. A load according to claim 11, wherein the support elements comprise a recess for receiving the strap of the load.

13. A load according to claim 12, wherein the strap of the load comprises a dent at the point of attachment to the recess of the support element.

14. A beam according to claim 11, wherein said tension element preserves a stress of the force carrying element.

15. A beam according to claim 14, wherein the tension element comprises at least one cable connected between two ends of the force carrying element, or wherein the tension element is stressed to between 50-200 kg tensile strength.

16. A pallet according to claim 14, wherein the beam is prestressed before attaching the tension element.

17. A beam according to claim 11, wherein the force carrying element is in the form of one member of the group consisting of a curved arch and a triangular truss.

18. A beam according to claim 11, wherein the beam is adapted to carry between 120-200 kg of load for each 1 kg of raw material of the beam.

19. A method of attaching a strap to a beam to secure a load, the method comprising:

providing a load;

providing a strap;

providing at least one beam for supporting the load, the beam having a first lateral end and a second lateral end and an upper side and a lower side;

providing a cable on a lower side of said beam between said first lateral end and said second lateral end to curve said beam in a direction of said lower side between said first lateral end and said second lateral end, thereby to maintain a tension in said beam, the tension being towards said lower side;

placing the load on said upper side of the beam opposite said tensioned side; and closing the strap over the load between ends of the beam thereby attaching the load to the curved beam, the cable causing said curving to be retained.

20. A method according to claim 19, wherein providing the tension cable comprises tightening the tension cable, thereby stressing the beam.

* * * * *